US008434965B2

(12) United States Patent
Chae

(10) Patent No.: US 8,434,965 B2
(45) Date of Patent: May 7, 2013

(54) IMPACT ABSORPTION FACILITY FOR ROAD

(75) Inventor: Jong-Sul Chae, Namwon-si (KR)

(73) Assignee: Geum Sung Industry Co., Ltd., Jeonbuk (KR)

( * ) Notice: Subject to any disclaimer, the term of this patent is extended or adjusted under 35 U.S.C. 154(b) by 0 days.

(21) Appl. No.: 13/521,373

(22) PCT Filed: Jan. 13, 2010

(86) PCT No.: PCT/KR2010/000217

§ 371 (c)(1),
(2), (4) Date: Jul. 10, 2012

(87) PCT Pub. No.: WO2010/093122

PCT Pub. Date: Aug. 19, 2010

(65) Prior Publication Data

US 2013/0017015 A1 Jan. 17, 2013

(30) Foreign Application Priority Data

Feb. 10, 2009 (KR) ..... 10-2009-0010776
Dec. 31, 2009 (KR) ..... 10-2009-0136281

(51) Int. Cl.
*E01F 15/02* (2006.01)
*E01F 15/08* (2006.01)

(52) U.S. Cl.
USPC ..... 404/6; 404/10; 256/13.1

(58) Field of Classification Search ..... 404/6, 10; 256/13.1; 114/220
See application file for complete search history.

(56) References Cited

U.S. PATENT DOCUMENTS

| | | | | | |
|---|---|---|---|---|---|
| 3,292,909 | A * | 12/1966 | Bianchi | 256/13.1 |
| 3,416,484 | A * | 12/1968 | Chapman | 116/67 R |
| 5,238,228 | A * | 8/1993 | Moon | 256/13.1 |
| 5,549,279 | A * | 8/1996 | Aszkenas | 256/13.1 |
| 5,678,365 | A * | 10/1997 | Venegas, Jr. | 52/174 |
| 5,809,733 | A * | 9/1998 | Venegas, Jr. | 52/835 |
| 6,059,487 | A * | 5/2000 | Haga et al. | 404/6 |
| 6,427,411 | B2 * | 8/2002 | Shows | 52/515 |
| 6,520,711 | B2 * | 2/2003 | Kim | 404/6 |
| 7,287,930 | B2 * | 10/2007 | Yamasaki et al. | 404/10 |
| 7,617,792 | B1 * | 11/2009 | Pursley | 114/219 |
| 8,282,082 | B2 * | 10/2012 | An | 256/13.1 |

FOREIGN PATENT DOCUMENTS

| | | |
|---|---|---|
| EP | 1256659 | 11/2002 |
| JP | 2007126814 | 5/2007 |
| KR | 200391872 | 8/2005 |
| KR | 100740552 | 7/2007 |

* cited by examiner

*Primary Examiner* — Gary Hartmann
(74) *Attorney, Agent, or Firm* — IPLA P.A.; James E. Bame

(57) ABSTRACT

An impact absorption facility for road makes it possible to protect a road center, a road side, a road ramp, an entering side of a tunnel or an underground road, pillars, faith silk or others and to absorb the impact of vehicle collided and to decelerate during a collision by decreasing the impacts occurring due to the impact of a vehicle by installing the impact absorption facility even in a highway ramp, and it is possible to prevent a vehicle from entering an opposite road lane or going out of a road for thereby allowing the vehicle to run on a normal road and to return to a road. A traffic accident can be effectively prevented with the help of a lighting lamp or a reflection lamp when a vehicle approaches the impact absorption facility when a driver drives at night with sleepiness.

17 Claims, 27 Drawing Sheets

IMPACT ABSORPTION FACILITY FOR ROAD

BACKGROUND OF THE INVENTION

The present invention relates to an impact absorption facility for road, and in particular to an impact absorption facility for road which makes it possible to protect a road center, a road side, a road ramp, an entering side of a tunnel or an underground road, pillars, faith silk or others and to absorb the impact of vehicle collided and to decelerate during a collision by decreasing the impacts occurring due to the impact of a vehicle by installing the impact absorption facility even in a highway ramp, and it is possible to prevent a vehicle from entering an opposite road lane or going out of a road for thereby allowing the vehicle to run on a normal road and to return to a road. A traffic accident can be effectively prevented with the help of a lighting lamp or a reflection lamp when a vehicle approaches the impact absorption facility when a driver drives at night with sleepiness.

Since a conventional impact absorption facility is formed of a protective wall, a protective mount, a guide rail each made of a waste tire, a steel material or concrete, the friction force increases at the time when a vehicle collides, so a vehicle is damaged or broken, leading to casualties.

The conventional impact absorption facility is generally made of a concrete block or a steel material. The impact absorption facility is installed in one side of an asphalt road or a road side of a pedestrian road. The impact absorption facility is made by installing a basic concrete after casting and by vertically installing a steel pile in a center of the basic concrete. A zinc-coated steel plate formed in a wing shape is installed in the steel pile in a road side.

The conventional impact absorption facility is most widely used with its easier construction. In the road crossing a housing complex, the impact absorption facility made of a concrete block is installed, and a noise absorption plate is installed.

As vehicle collision accidents increase year after year, a lot of impact absorption facilities installed in a sharp curve and a mountain area are damaged. In particular, since it is made of a metallic material or a concrete block, casualties might increase when a vehicle collides, and a lot of budget is needed so as to maintain the damaged impact absorption facility.

In order to overcome the above problems, a vehicle collision absorption apparatus is installed in a place where a vehicle can collide. The impact absorption facility with an impact absorption apparatus can be classified into a recovery type impact absorption facility with a function for recovering the vehicle in a direction that the vehicle is originally intended to run, and a non-recovery type impact absorption facility which can make the vehicle stop as the facility fully absorbs the impact of the vehicle.

Generally, the impact absorption facility is installed so as to secure the safety of passenger by stopping the vehicle or changing the direction of the vehicle when colliding with fixed structure and so as to prevent a secondary accident that a certain accident occurs after the vehicle collided with the obstacle and so as to protect the major structures of the road such as a pillar or the something.

Such impact absorption facility is installed in a place where needs a protection of people and facility due to the collision with the vehicle like in the center line of the road or a road side, a road junction, an end portion, a pillar, a highway tollgate, a tunnel, an underground entrance, a retained wall, a down slope section of a curved road, etc.

In case of the impact absorption facility embedded in the center line of the road or the road side, it can effectively absorb and distribute the impact for thereby decreasing the accident and the hurts of people. However t is impossible to actually decrease the speed of the vehicle due to the rotational force of the impact absorption member such as a manmade absorption material like waste tires and Styrofoam. When impacting, the speed the vehicle generally increases, so the vehicle goes out of the running lane. In this case, a secondary accident may occur as the vehicle collides with another running vehicle of another running lane, which might cause a huge accident.

The impact absorption facility embedded in the centerline or the road side has a complicated construction which might lead to increasing the unit cost, and the assembling time might increase due to a lot of elements to be assembled at site. In particular, when it is hard to see the front side vehicles in curved roads or uphill roads, the vehicle collides and keeps running without deceleration, from which a huge accident can occur.

In the road protective member for impact absorption of Korean patent registration number 0740552, the following problems might occur. Namely, since the vehicle collides and keeps running with its before-accident speed, the impact absorption body maintains original rotational speed. So, the vehicle that collided might collapse and might get popped out of the running road. Since the rotational speed of the impact absorption body is in proportion to the impact speed in the course of the impact of the vehicle, it is actually hard to prevent safety accidents due to the deceleration of a vehicle, so that a secondary traffic accident such as a collapse or a road escape can occur.

SUMMARY OF THE INVENTION

Accordingly, it is an object of the present invention to provide an impact absorption facility for road which has ultraviolet ray block, dust attachment prevention, light reflection and nightglow and makes it possible to absorb and release the impacts that the vehicle receives when the vehicle collides with the impact absorption facility with an elastic member such as rubber or synthetic resin which is capable of absorbing the impacts. It is possible to decrease the speed of the vehicle at the time of vehicle collision while guiding the vehicle to run an intended running direction, so the driver can reenter the normal running way while holding the handle.

It is another object of the present invention to provide an impact absorption facility for road which can protect ramp inlets and outlets, entrance of tunnel or underground way, pillars, faith silk or something and decreasing the impacts when a vehicle collides with an impact absorption facility installed at a highway ramp or junction and preventing a vehicle from entering a center line and getting out of the road for thereby minimizing a huge accident and the damages of vehicles and passengers.

It is further another object of the present invention to provide an impact absorption facility for road which makes it possible to easily manage by fabricating the structure of an impact absorption facility for road in an assembling type for thereby easily exchanging the damaged elements when the vehicle is damaged by accidents. A LED solar cell which automatically flashes and has a solar cell battery is installed in the upper side of the pillar of the impact absorption facility for thereby preventing the accidents with the help of the flashing of the LED lamp at night.

It is still further another object of the present invention to provide an impact absorption facility for road in which a foam polymer is filled in the course of manufacturing of the cushioning roller member of the impact absorption facility for road in order to maximize the releasing effect due to impact. Male threads are formed on an outer surface of the reinforcing pipe in order for the center coupling member of the cushioning roller member to keep its original state, and female threads are formed on the inner surface of the coupling member during the foaming process for thereby securing a stable and tight coupling with the reinforcing pipe, so it is possible to minimize the transformation of the coupling member against the contraction and expansion of the foam polymer.

It is still further another object of the present invention to provide an impact absorption facility for road in which maintenance is easy by easily changing the damaged elements due to the collisions by fabricating the road protective member in a separable form and the accidents can prevented with the help of flashing lights or reflection lamp when the vehicle approaches.

To achieve the above objects, in an impact absorption facility for road which is installed in a centerline of a road or a road side for absorbing and distributing the impact when a vehicle collides, there is provided an impact absorption facility for road which comprises a plurality of piles which are installed in a centerline of a road or a road side at regular intervals and are shaped in column-shapes; a rotation support pipe 20 which is rotatably engaged to the pile 10; a plurality of cushioning roller members 200*a* which are rotatably engaged to an outer surface of the rotation support pipe 20 and are equipped with engaging members 201 with the inner and outer sides of the same being made of integral elastic rubber materials and being formed in cylindrical shapes, with the outer side of the same being equipped with a high luminance reflection band 205; a plurality of safety rails 300*a* which are installed in the cushioning roller member at regular intervals and are horizontally installed to both sides of the upper and lower side of each pile 10; a first rotation block plate 600*a* which is installed in upper and lower ends of an outer surface of the rotation support pipe 20 equipped with the cushioning roller member 200*a*, with a first fixing groove 21 being formed in one surface of the rotation support pipe 20, with a second fixing groove 602 being formed in part of an inner surface of the engaging hole 601 and fixed by means of a first fixing pin 22, with a plurality of upwardly protruded radial first protrusions being formed in one side of the same; and a second rotation block plate 600*b* which is installed in the upper and lower sides of the pile 10 for mounting on the upper and lower surfaces of the first rotation block plate 600*a* installed in the upper and lower sides of the rotation support pipe 20, with a third fixing groove 11 being formed in one surface of the pipe 10, with a fourth fixing groove 602 being formed in pat of an inner surface of the engaging hole 601 for fixing by means of a second fixing pin 12, with a plurality of upwardly protruded radial first protrusions 603 being formed in the second rotation block plate 600*b* and engaged with one side in which the first protrusions 603 of the first rotation block plate 600*a* are formed.

As described above, the present invention can protect ramp inlets and outlets, entrance of tunnel or underground way, pillars, faith silk or something and decreasing the impacts when a vehicle collides with an impact absorption facility installed at a highway ramp or junction and preventing a vehicle from entering a center line and getting out of the road for thereby minimizing a huge accident and the damages of vehicles and passengers.

The present invention makes it possible to easily manage by fabricating the structure of an impact absorption facility for road in an assembling type for thereby easily exchanging the damaged elements when the vehicle is damaged by accidents. A LED solar cell which automatically flashes and has a solar cell battery is installed in the upper side of the pillar of the impact absorption facility for thereby preventing the accidents with the help of the flashing of the LED lamp at night.

In the present invention, a foam polymer is filled in the course of manufacturing of the cushioning roller member of the impact absorption facility for road in order to maximize the releasing effect due to impact for thereby minimizing the transformation of the coupling member against the contraction and expansion of the foam polymer.

Accidents can be effectively prevented with the help of flashing light or reflection lamps when the vehicle approaches the impact absorption facility in order to prevent the accidents occurring due to sleepiness and carelessness when driving at night.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE INVENTION

The preferred embodiments of the present invention will be described with reference to the accompanying drawings.

Figure 1:
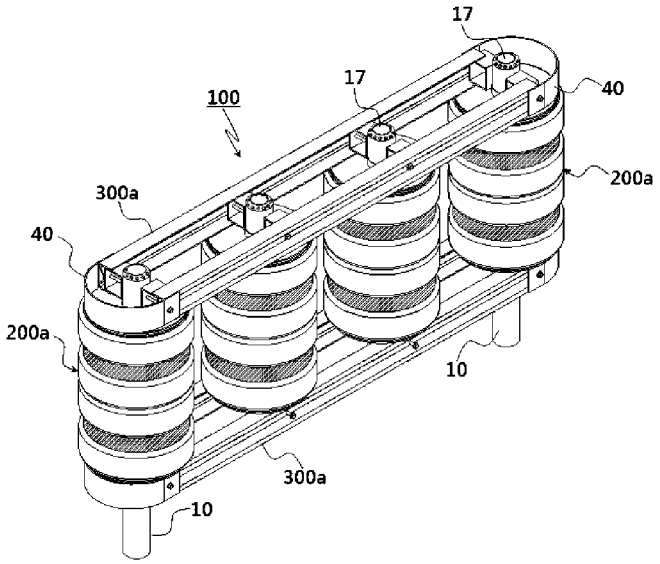
FIG. 1 is a perspective view illustrating an impact absorption facility for road according to the present invention.
Figure 2:
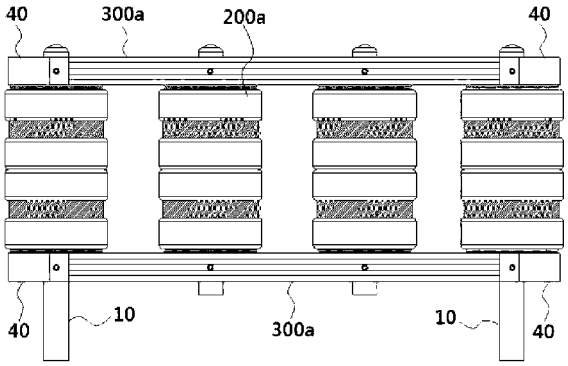
FIG. 2 is a front view illustrating an impact absorption facility for road according to the present invention.
Figure 3:
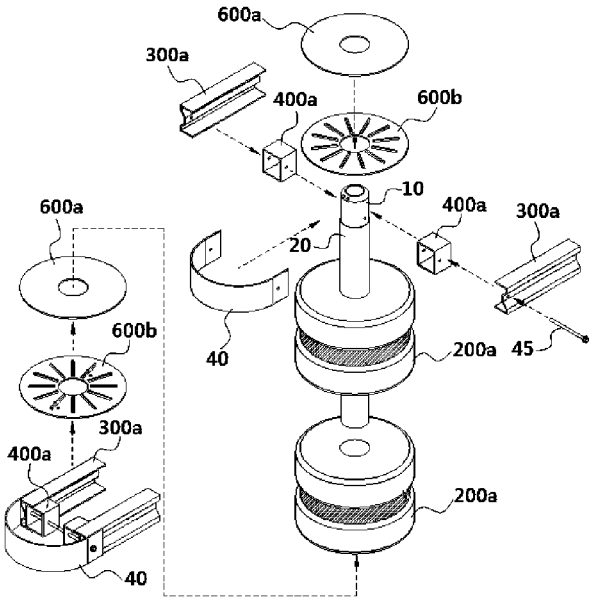
FIG. 3 is a separated perspective view illustrating an impact absorption facility for road according to the present invention.

As shown in FIGS. 1 to 3, the present invention is basically directed to an impact absorption facility for road which is installed in a centerline of a road or road sides for thereby absorbing and distributing the impacts occurring when a vehicle collides.

The present invention includes a column-shaped pile 10 fixedly embedded in a centerline of a road or road sides at regular intervals, and a rotation support pipe 20 which is engaged with the help of the pipe 10 and is rotatable.

The rotation support pipe 20 includes an engaging member 201 which is engaged to its outer side and is rotatable, a plurality of cushioning members 200*a* each formed in a cylindrical shape and made from integral elastic rubber material in its inner and outer sides, with a high luminance reflection band 205 being engaged to each cushioning member, and a plurality of safety rails 300*a* which are installed in the cushioning roller member 200*a* at regular intervals and are integrally horizontal in the upper and lower sides of each pile 10.

Figure 12:
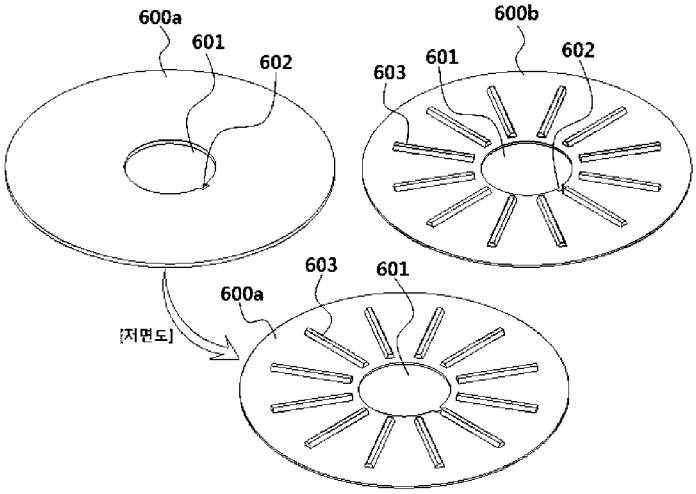
FIG. 12 is a view of a construction of first and second rotation block plates of an impact absorption facility for road according to the present invention.

The facility of the present invention is installed in the upper and lower sides of the outer surface of the rotation support pipe 20 with the cushioning roller member 200*a*. A first fixing groove 21 is formed in one surface of the rotation support pipe 20, and as shown in FIG. 12, a second fixing groove 602 is formed in a portion of the inner surface of the engaging hole 601 and is fixed by means of a first fixing pin 22. A first rotation block plate 600*a* is provided with a plurality of first protrusions 603 upwardly protruded from its one surface in a radial shape.

Figure 5:
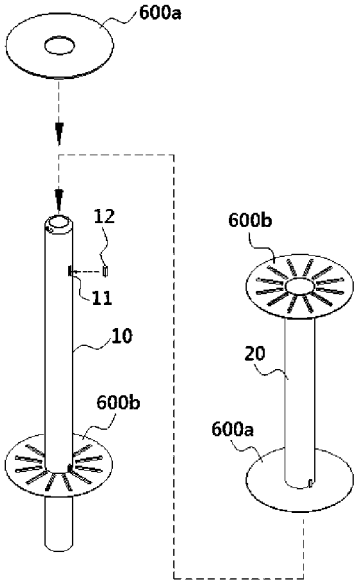
FIG. 5 is a view illustrating a construction after first and second rotation block plates are assembled to a pile and a rotation support pipe of an impact absorption facility for road according to the present invention.

The rotation support pipe 20 is installed in the upper and lower sides of the pipe 10 so that its upper and lower sides are mounted on the upper and lower surfaces of the first rotation block plate 600*a*. As shown in FIG. 5, the pile 10 is provided with a third fixing groove 11 in its one side, and a fourth fixing groove 602 is formed in a portion of the inner surface of the engaging hole 601, so the pile can be stably fixed with the help of a second fixing pin 12.

The present invention further includes a second rotation block plate 600*b* with a plurality of first protrusions 603 upwardly protruded from one surface in a radial shape for thereby being engaged with one surface in which the first protrusion 603 of the first rotation block plate 600*a* is formed.

Figure 4:
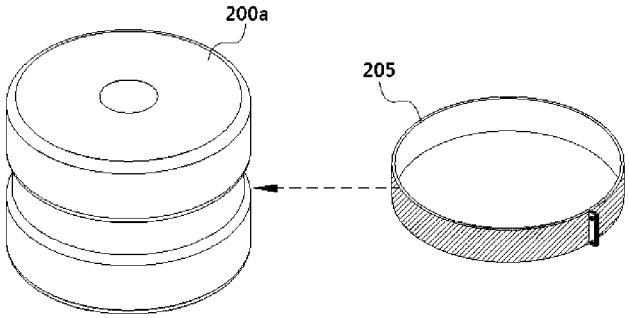
FIG. 4 is a view illustrating an engagement for attaching a high luminance reflection band to a cushioning roller member of an impact absorption facility for road according to the present invention.

As shown in FIG. 4, the cushioning roller member 200*a* is made with its inner and outer side being integrally covered with elastic rubber materials. A metallic high luminance reflection band 205 is engaged to its outer side. A reflection sheet or fluorescent paint can be covered on the outer side of the cushioning roller member 200*a* other than to use the high luminance reflection band 205.

The safety rail of FIG. 3 can be formed of a safety rail which has a M shape when viewing its vertical cross section after reversing 90 degrees, but another type of safety rail, safety bar or guardrail can be used for the same purpose.

Figure 6:
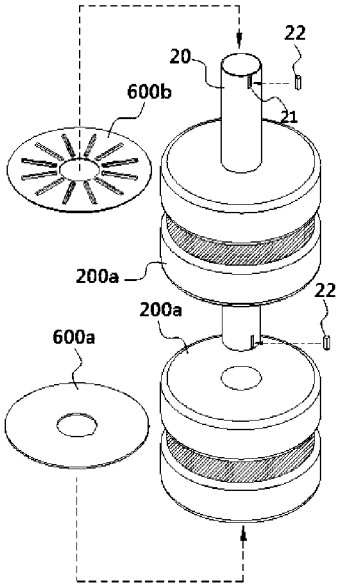
FIG. 6 is a view of a construction after a cushioning roller member, first and second rotation block plates are assembled to a rotation support pipe of an impact absorption facility for road according to the present invention.

As shown in FIG. 6, the first rotation block plate 600 is basically installed in the upper and lower sides of the outer surface of the rotation support pipe 20, and the first fixing groove 21 is formed in one surface of the rotation support pipe 20. The rotation support pipe 20 is inserted through the engaging hole 601 formed in the center of the first rotation block plate 600*a*. The second fixing groove 602 formed in a portion of the inner surface of the engaging hole 601 and the first fixing groove 21 of the rotation support pipe 20 are surface-contacted with each other, and the first fixing pin 22 is inserted into the first and second fixing grooves 21 and 602, respectively, for thereby stably fixing the first rotation block plate 600*a*.

As shown in FIG. 5, the second rotation block plate 600*b* is inserted into the pile 10 for thereby fixing the second rotation block plate 600*b* to the pile 20 in the same method as the first rotation block plate 600*a*.

Figure 7:
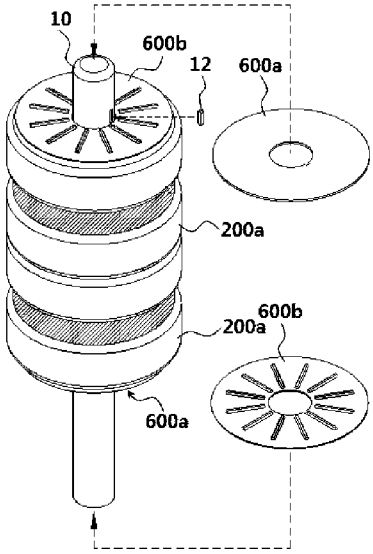
FIG. 7 is a view of a construction after the facility of the present invention is engaged to a pile in a state that first and second rotation block plates and a cushioning roller member of an impact absorption facility for road according to the present invention.

As shown in FIGS. 6 and 7, the cushioning roller member 200*a* is inserted into the rotation support pipe 20 before the first rotation block plate 600*a* is fixed in the inner surface of the rotation support pipe 20. In addition, the rotation support pipe 20 with the cushioning roller member 200*a* and the first rotation block plate 600*a* is inserted into the pile 10 before the second rotation block plate 600*b* is fixed to the pile 10.

The first and second block plates 600*a* and 600*b* are installed in the pile 10, and it is preferred that the first protrusions 603 formed in the surfaces of the first and second rotation block plates 600*a* and 600*b* are engaged facing each other.

As shown in FIG. 3, a protection piece 40 is further provided, which is installed at both sides of the impact absorption facility 100 for road and is engaged to the outer side of each safety rail 300*a* formed at both sides of the pile 10 with the help of bolts 45 and is formed in a curved plate shape, by means of which a further cushioning effect can be obtained in front of the impact absorption facility 100 when a vehicle collides.

As shown in FIGS. 1 and 2, in view of the pile 10 of the impact absorption facility 100 for road, the pile 10 with the cushioning roller member 200*a* installed at both sides of the impact absorption facility 100 for road is fixed on the ground, and the pile 10 except for the pile 10 installed at both sides of the impact absorption facility 100 for road may be installed, not being fixed on the ground.

When it is needed to change the structure of the impact absorption member 40 due to the collisions of the vehicle, the pile 10 fixed on the ground should be removed, causing a lot of inconveniences along with a cost increase and a work time increase.

So, only the pile 10 installed at both sides of the impact absorption facility 100 for road is fixed on the ground. Namely, the piles 10 except for the pile 10 fixed on the ground are not fixed to the ground, while just supporting the cushioning roller member 200*a* and the first and second rotation block plates 600*a* and 600*b* engaged in the rotation support pipe 20.

Figure 8:
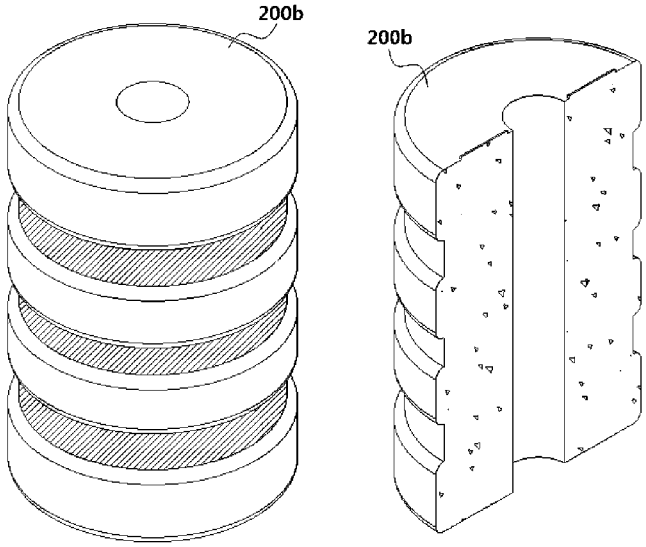
FIG. 8 is a view of a construction of an integrated type cushioning roller member of an impact absorption facility for road according to the present invention.

As shown in FIG. 8, an integral cushioning roller member 200*b* can be installed other than to install a plurality of cushioning roller members 200*a* inserted into the pile 10 for thereby enhancing the absorption when a vehicle collides, and the impacting rotation speed can be fast decreased.

Figure 9:
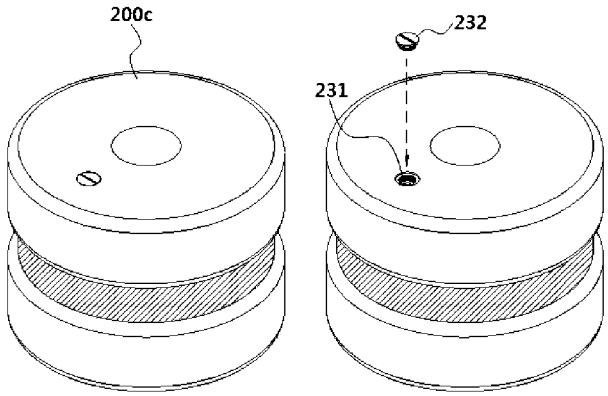
FIG. 9 is a view of a construction of a cushioning roller member with a space part in its interior in an impact absorption facility for road according to the present invention.
Figure 10:
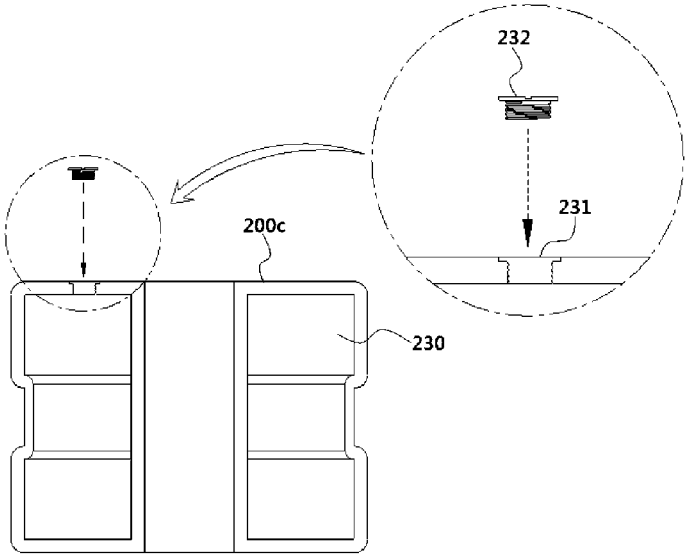
FIG. 10 is a view of the interior of a cushioning roller member of an impact absorption facility for road of FIG. 9 according to the present invention.
Figure 11:
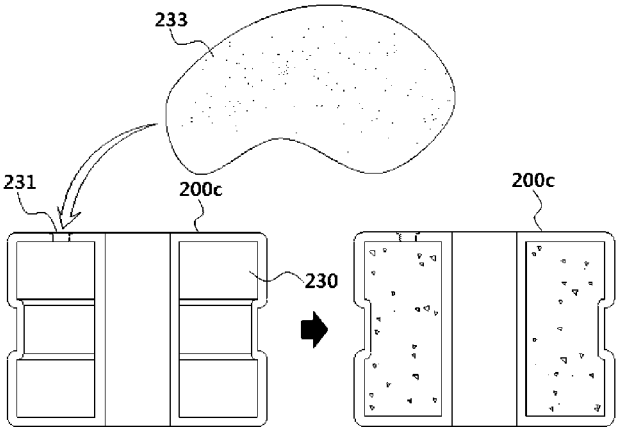
FIG. 11 is a view of a construction that urethane is filled in a space part of a cushioning roller member of an impact absorption facility for road of FIG. 9 according to the present invention.

As shown in FIGS. 9 to 11, a hollow space part 230 is formed in the interior of the cushioning roller member 200*c*, and an inlet 231 is formed on an upper surface of the cushioning roller member 200*c* and is sealed by means of a stopper 232, and a room temperature foam urethane 233 is inputted through the inlet 231, so that urethane foam is formed in the space part 230.

When a certain time passes after the room temperature foam urethane 233 is inputted through the inlet 231 of the cushioning roller member 200*c* with the space part 230, the urethane 233 inputted in the space part 230 is foamed and becomes dense in the space part 230 with the help of which construction work is easy, and the cost can be reduced.

It is preferred that the cushioning roller member 200*c* with the space part 230 in its interior is integrally formed of plastic molding.

Figure 13:
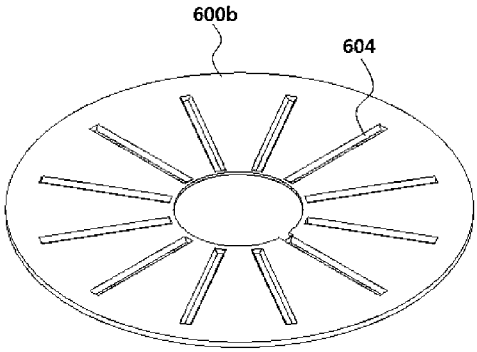
FIG. 13 is a perspective view of a construction that a first engaging groove is formed on the upper surfaces of first and second rotation block plates of an impact absorption facility for road according to the present invention.

As shown in FIG. 12, either the first rotation block plate 600*a* or the second rotation block plate 600*b* is equipped with a first engaging groove 604, as shown in FIG. 13, in its one surface instead of the first protrusion 603.

The first engaging groove 604 is formed in a radial concave groove shape in the surface of the first and second rotation block plates 600*a* and 600*b*. The first protrusion 603 formed in one surface of the first rotation block plate 600*a* rotates, being engaged with the first engaging groove 604 formed in one surface of the second rotation block plate 600*b*. As the protrusion 603 rotates while continuing to insert into or disengage from the first engaging groove 604, the rotation speed can be further decreased.

Figure 14:
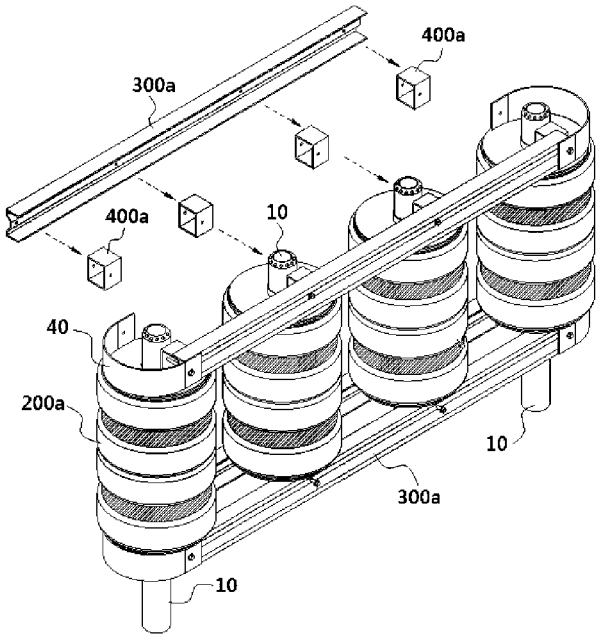
FIG. 14 is a view of a construction that an impact absorption plate 400*a* is installed in an impact absorption facility for road according to the present invention.

As shown in FIG. 14, one surface of each pile 10 surface-contacts with the safety rail 300*a*. A tetrahedron shaped impact absorption plate 400*a* of which both sides pass through for a surface contact with one surface of each pile 10 is provided.

The tetrahedron shaped impact absorption plate 400*a* of which both sides pass and which is installed between one surface of the pile 10 and the safety rail 300*a* has a certain size enough for substantially covering the width of the pile 10. The impact absorption plate 400*a* and the safety rail 300*a* are engaged in sequence to one surface of the pile 10 with the help of the bolts 45.

When engaging with the bolts 45, it is preferred to use a long side bolt 45 in order to reach from the other side of the pile 10 to another impact absorption plate 400*a* and a safety rail 300*a*.

When a vehicle collides in the direction of the pile 10 of the impact absorption facility 100 for road, it is possible to obtain further cushioning performance with the help of the impact absorption plate 400*a* of the pile.

Figure 15:
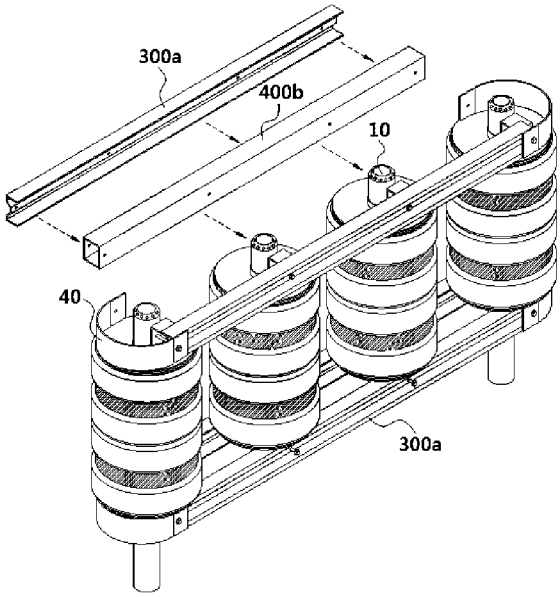
FIG. 15 is a view of a construction that an impact absorption plate 400*b* is installed in an impact absorption facility for road according to the present invention.

As shown in FIG. 15, a rectangular pipe shaped impact absorption plate 400*b* can be further installed in the longitudinal direction of the safety rail 300*a* other than to install the tetrahedron impact absorption plate 400*a* of which both sides pass and has a certain length as long as the width of the pile 10 in the rear side of the safety rail 300*a*, so it is possible to obtain a further cushioning effect with the help of the impact absorption plate 400*b* when a vehicle collides with the pile and the safety rail.

Figure 16:
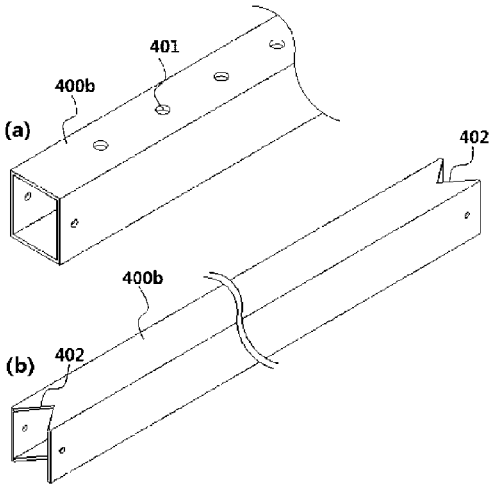
FIG. 16 is a view of a construction that a first through hole (a) and a cut-away groove (b) are formed in an impact absorption plate 400*b* of an impact absorption facility for road according to the present invention.

As shown in FIG. 16A, a plurality of first through holes 401 are longitudinally formed on the upper and lower sides of the rectangular pipe shaped impact absorption plate 400*b* at regular intervals for thereby reducing the time that the rectangular pipes are crushed.

Since the first through holes 401 are formed in the upper and lower sides of the impact absorption plate 400*b*, it is possible to concentrate the force and pressure occurring in the course of collision into one way for thereby obtaining instant cushioning and elastic force.

As shown in FIG. 16B, forming the V shaped cut-away groove 402 at each both side of the upper and lower surfaces of the rectangular pipe shaped impact absorption plate 400*b* is to obtain the same principles and operation effects as the first through hole 401 is formed on the upper and lower surfaces of the impact absorption plate 400*b*.

Figure 17:
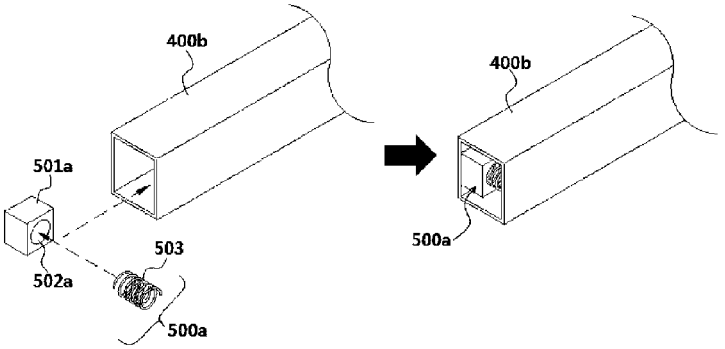
FIG. 17 is a view of a construction that a first impact member is assembled to an impact absorption plate 400*b* of an impact absorption facility for road according to the present invention.

As shown in FIG. 17, the rectangular pipe shaped impact absorption plate 400*b* includes a tetrahedron shaped rubber material cushioning plate 501*a* with an insertion port 502*a* being formed on one surface in the interior of its both ends, and a first impact member 500*a* with a cushioning spring 503 inserted in part into the insertion port 502*a*.

The first impact member 500*a* is installed in the interior of both sides of the impact absorption plate 400*b*, so a first impact cushioning operation by means of the impact absorption plate 400*b* and a second impact cushioning operation by means of the cushioning spring 503 of the first impact member 500*a* and the cushioning plate 501*a* made of a rubber material can be simultaneously obtained when a vehicle collides.

Figure 18:
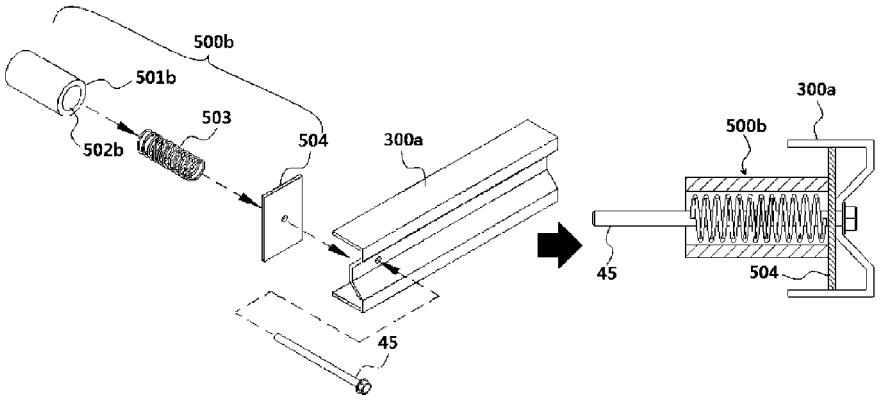
FIG. 18 is a view of a construction that a second impact member is installed in an impact absorption facility for road according to the present invention.

As shown in FIG. 18, instead of using the impact absorption plates 400*a* and 400*b*, a cushioning plate 501*b* made of a cylindrical rubber material with an insertion port 502*b* in its one surface and a second impact member 500*b* which has a cushioning spring 503 inserted in part into the insertion port 502*b* and a plate shaped washer 504 installed in a front end of the cushioning spring 503 can be used.

The cushioning spring 503 installed in the rear side of the safety rail 300*a* and the rubber cushioning plate 501*b* can help cushion the impacts in order to decrease the impacts of the safety rail 300*a* when a vehicle collides with the safety rain 300*a*.

Figure 19:
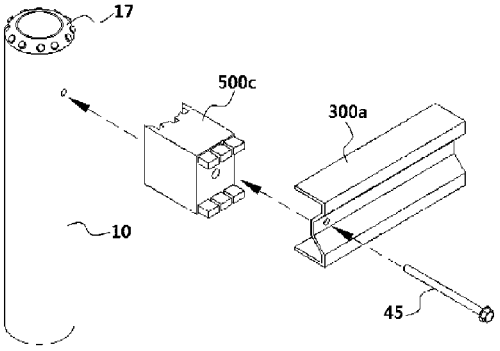
FIG. 19 is a view of a construction that a third impact member is installed in an impact absorption facility for road according to the present invention.
Figure 20:
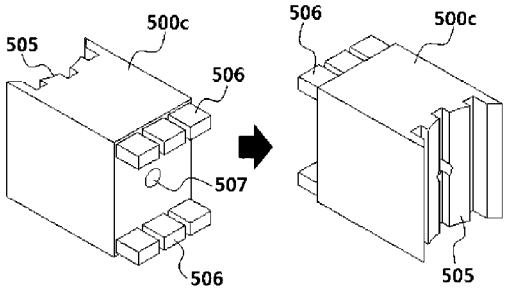
FIG. 20 is a view of a third impact member of an impact absorption facility for road according to the present invention.

As shown in FIGS. 19 and 20, instead of using the second impact member 500*b*, a third impact member 500*c* can be used with one surface equipped with a first protruded piece 505 formed in a vertical longitudinal direction in a curved shape, with the other surface equipped with a plurality of second protruded pieces 506 protruded in upper and lower sides, with an engaging member 45 passing through one surface and the other surface.

With the above construction of the present invention, when a vehicle collides with the safety rail 300*a*, part of the safety rail 300*a* between the pile 10 and the pile 10 is pulled in the collision direction, and at this time one surface with the first protrusion piece 505 of the third impact member 500*c* is formed on one surface of the pile 10 in order for the safety rail 300*a* positioned between one pile 10 and another pile 10 to keep its original state. So, the vertical first protrusion piece 505 formed on one surface of the third impact member 500*c* can effectively resist the impact force which is transferred to the safety rail 300*a*.

In order to reduce the impact force of the safety rail 300*a* when a vehicle collides, the third impact member 500*c* has a second protrusion piece 506 in its upper and lower surfaces of the other surface, so the impact force can be reduced or released with the help of surface contact by means of the second protrusion piece 506, not by the direct contact with one surface of the safety rail 300*a*.

Figure 21:
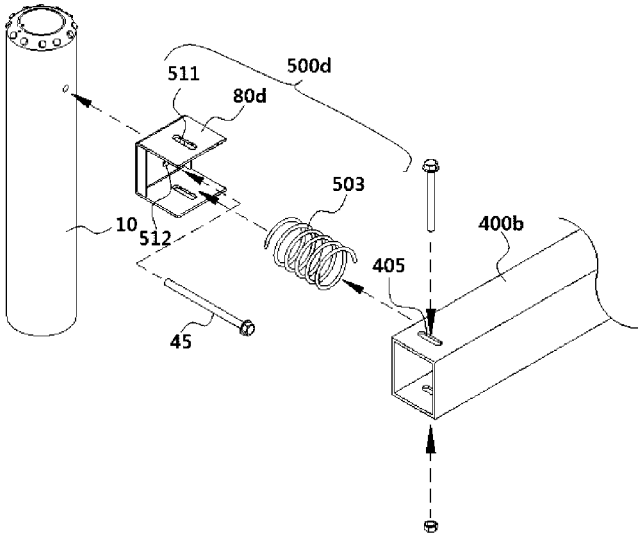
FIG. 21 is a view of a construction that a fourth impact is assembled to an impact absorption facility for road according to the present invention.

As shown in FIG. 21, an impact absorption plate 400*b* is installed, exposed, without installing the safety rail 300*a*. When the impact absorption plate 400*b* is fixed on one surface of the pile, an eclipse-shaped second bolt hole 511 is formed in the upper and lower surfaces, respectively, for an engagement using the bolts and nuts.

A channel-shaped engaging fixture 510 with a third bolt hole 512 in one surface is provided for fixing on one surface of the pile 10, and a fourth impact member 500*d* with a cushioning spring 503 is provided in the channel-shaped engaging fixture 510.

The engaging fixture 510 with the cushioning spring 503 is equipped with an impact absorption plate 400*b* in its interior, so the upper and lower surfaces of the engaging fixture 510 are engaged like covering the upper and lower surfaces of the impact absorption plate 400*b* for thereby being fixed to one surface of the pile 10.

Figure 22:
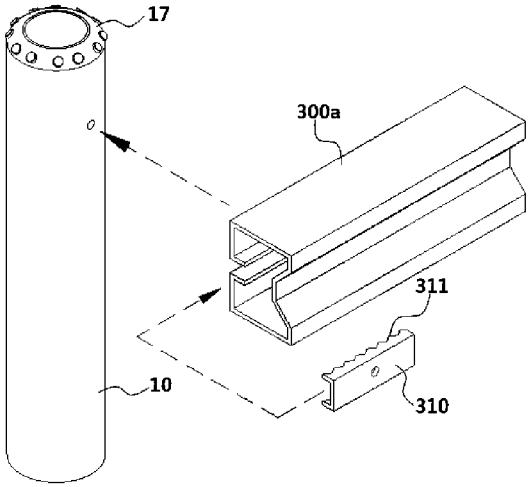
FIG. 22 is a view of a construction that a safety rail and an insertion piece are assembled in an impact absorption facility for road according to the present invention.
Figure 23:
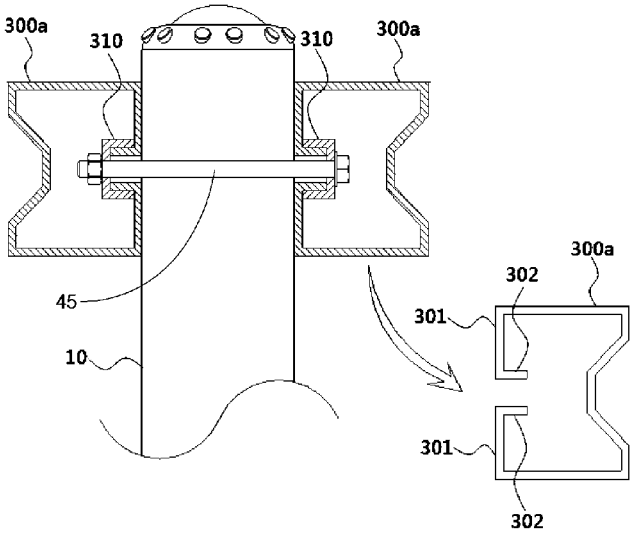
FIG. 23 is a cross sectional view of a construction that a safety rail and an insertion piece are assembled in an impact absorption facility for road of FIG. 22 according to the present invention.

As shown in FIGS. 22 and 23, the safety rail 300*a* further includes an extension piece 301 of which both ends are inwardly bent, and a shoulder part 302 is bent in one direction of the extension piece 301, and a channel-shaped insertion piece 310 is inserted into the shoulder part 302.

A safety rail 300*a* is engaged to one side of the pile 10 in order to minimize the pulling phenomenon in the collision direction of the safety rail 300*a* when a vehicle collides with the safety rail 300*a* for thereby obtaining a more stable engagement. The insertion piece 310 inserted into each shoulder part 302 bent by means of the extension piece 301 of the safety rail 300*a* is engaged to one side of the pile using the bolts 45 in order to prevent a pulling phenomenon of the safety rail 300*a*.

When engaging by mans of the bolts 45, the insertion piece 310 is strongly contracted with one side in a state that the insertion piece 310 accommodates/surface-contacts with the shoulder part 302 for thereby preventing a pulling phenomenon of the safety rail 300*a*.

As shown in FIG. 22, a tooth part 311 is formed in the ends of the upper and lower sides of the insertion piece 310, so the tooth part 311 formed in the ends of the upper and lower sides of the insertion piece 310 is strongly contacted with the shoulder part 302 of the safety rail 300*a* for thereby tolerating a pulling phenomenon of the safety rail 300*a*.

Figure 24:
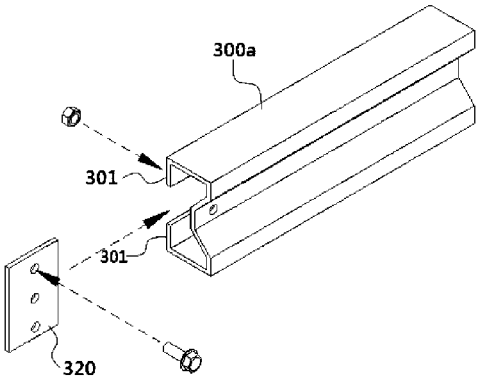
FIG. 24 is a view of a construction that a safety rail and a reinforcing plate are assembled in an impact absorption facility for road according to the present invention.
Figure 25:
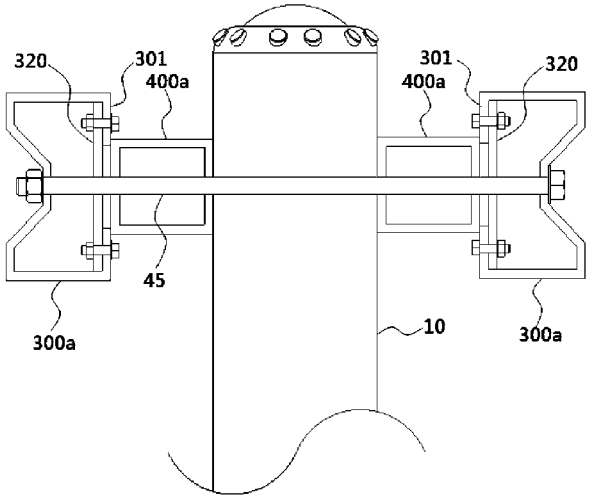
FIG. 25 is a cross sectional view of a construction that a safety rail and a reinforcing plate are assembled in an impact absorption facility for road of FIG. 24 according to the present invention.

As shown in FIGS. 24 and 25, the safety rail 300*a* further includes an extension piece 301 of which both ends are inwardly bent, and a plate shaped reinforcing plate 320 surface-contacts with a back side of the extension piece 301 formed in the upper and lower sides and is engaged by means of bolts and nuts.

The impact absorption plate 400*a* is surface-contacted with a back side of the safety rail 300*a* equipped with the reinforcing plate 320. It is engaged to the pile 10 using the bolts 45. So, when a vehicle collides with the safety rail 300*a* equipped with the reinforcing plate 320, the safety rail 300*a* does not pull back in the left and right directions.

As shown in FIG. 25, the impact absorption plate 400*a* can be installed between the pile 10 and the safety rail 300*a*, but the safety rail 300*a* reinforced in such a manner that the reinforcing plate 320 is engaged to both sides of the pile 100 can be installed without using the impact absorption plate 400*a*.

Figure 26:
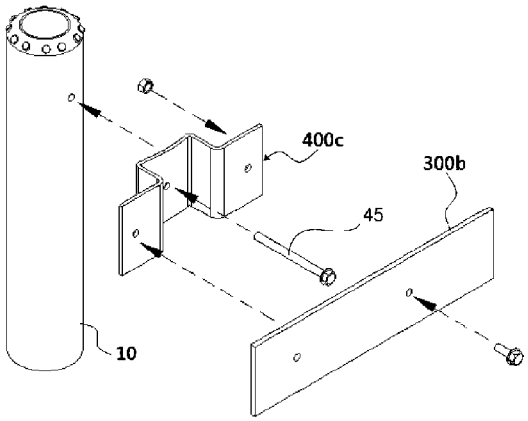
FIG. 26 is a view of a construction that a tensional member and an elastic member are installed in an impact absorption facility for road according to the present invention.
Figure 27:
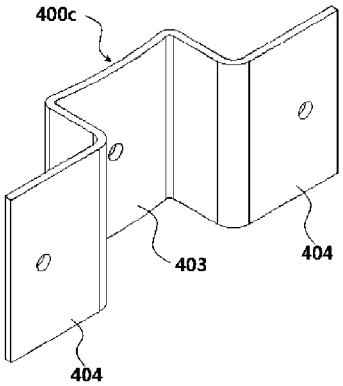
FIG. 27 is a perspective view of an elastic member of an impact absorption facility for road of FIG. 26 according to the present invention.

As shown in FIGS. 26 and 27, a curved support part 403 is engaged by the bolts to one side of the pole 10 other than to engage the safety rail 300*a*, and an elastic member 400*c* is provided, in which a surface contact part 404 is horizontally extended in both the directions of the support part 403. A plate shaped tension member 300*b* is engaged with the surface contact part 404 of the elastic member 400*c* and is arranged in the direction of the pile 10 of both side and in the longitudinal direction of the pile 10, respectively.

The impact force of the vehicle that is not substantially absorbed by means of the cushioning roller member 200*a* of the impact absorption facility 100 for road is further absorbed by means of the tension member 300*b* and the elastic member 400*c* and is offset. The impact of the vehicle first absorbed by means of a collision and transformation of the tension member 300*b* is naturally transferred to the tension member 300*b* with respect to the elastic member 400*c*, so a tensional transformation occurs. At the same time, the surface contact part 404 of the elastic member 400*c* is quickly bent and recovered along with the tension member 300*b* for thereby efficiently absorbing and offsetting the impact of the vehicle.

The impact of the vehicle transferred due to the collision with the impact absorption facility 100 for road according to the present invention is naturally absorbed by means of the collision transformation of the cushioning roller member 200*a*. The impact is further absorbed by means of the tension member 300*b*, which is tension-transformed, and the elastic member 400*c*, which is elastically transformed, along with the cushioning roller member 200*a*, from which it is possible to substantially absorb the impacts occurring due to the collision of the vehicle, so that the vehicle can be more effectively protected, and the vehicle can be prevented from escaping to the outside of the road.

Figure 28:
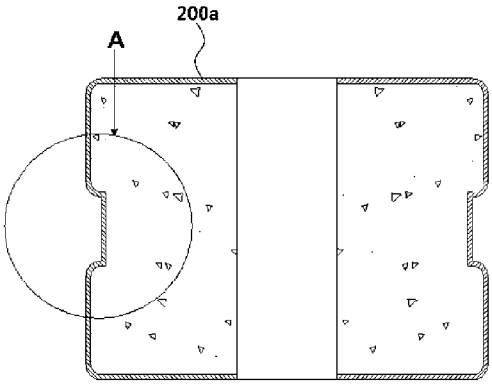
FIG. 28 is a cross sectional view of a state that a coating layer is coated on the surface of a cushioning roller member of an impact absorption facility for road according to the present invention.
Figure 29:
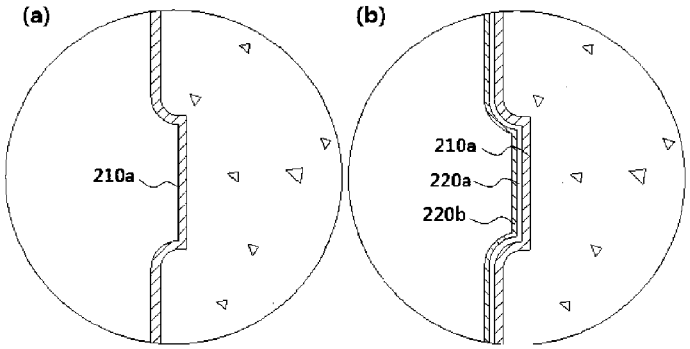
FIG. 29 is an enlarged view of the portions "a" and "b" of the section A coated by a certain material on the cushioning roller member of an impact absorption facility for road of FIG. 28 according to the present invention.

As shown in FIGS. 28 and 29A, a hardening agent is added to a binder which is selected from a liquid epoxy or a liquid acryl and is added to the surface of the cushioning roller member 200*a*. The binder and the hardening agent are mixed at the ratios of 900:0.8~1.2 weight % and are coated at room temperature, so a coating layer 210*a* with 1 mm to 5 mm thick is formed on the surface of the cushioning roller member 200*a*.

The coating layer 210*a* is directed to preventing the damages due to a corrosion of the cushioning roller member 200*a* from sunshine and aging, and it is possible to prevent alien substances from being stuck on the surfaces of the cushioning roller member 200*a*.

The binder used in the coating layer 210*a* can be one conventionally used in the industry, but is preferably selected from the group comprising epoxy, unsaturated polyester and acryl.

In the case of hardening agent, the hardening agent is mixed at the ratios of 900:0.8~1.2 weight %. When the ratio exceeds 1.2 weight %, the strength might be decreased due to faster hardening, and when the ratio is lower than 0.8 weight %, the hardening might be slowed, which were shown as a result of the experiments.

As shown in FIG. 29B, a light emitting paint is covered on the surface of the coating layer 210*a* within 2~3 seconds for thereby forming a light emitting coating layer 220*a* with 0.5 mm to 0.7 mm thick, and a protective layer 220*b* with 0.2 mm to 0.5 mm thick is formed by covering epoxy paint on the surface of the light emitting coating layer 220*a*.

The light emitting coating can be classified into a phosphorus coating which emits light when light is exposed to the material, a phosphor coating which keeps a light emitting state even when light is removed, and a night coating which emits lights as the electrons of a material returns from an excited state to a bottom level state through a semi-stable state. A light emitting paint can be made by adding a heavy metal into sulfides of alkali earth metal or zinc sulfide or by adding a small amount of radium to zinc sulfide containing cupper.

A protective layer 220*b* with 0.5 mm to 1 mm thick is formed by inputting the light emitting coating layer 220*a* into epoxy paint for 2 to 3 seconds for protecting the same.

Figure 30:
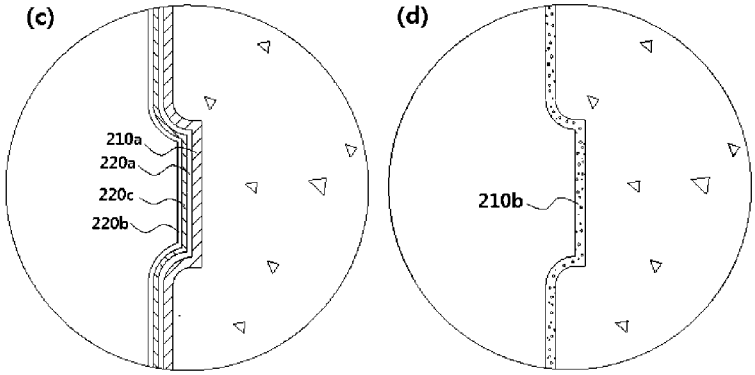
FIG. 30 is an enlarged view of the portions "c" and "d" of the section A coated by another material on the cushioning roller member of an impact absorption facility for road according to the present invention.

As shown in FIG. 30C, a liquid ultraviolet ray coating is coated on the surface of the light emitting coating layer 220*a* before the protective layer 220*b* is formed for thereby forming an ultraviolet ray block coating (UV coating) 220*c* for thereby protecting the surface of the cushioning roller member 200*a* as well as the coating layer 210*a* from corrosion or cracks.

As shown in FIG. 30D, a certain reflection material such as glass beads or glass powder is inputted into a binder in order for the coating layer 210*a* to emit lights at night, with the mixing ratio of the binder and the reflector being 1:0.7~1 weight %, so a reflection coating layer 210*b* is formed on the surface of the cushioning roller member 200*a*.

With the above structures, a driver can well recognize the objects ahead with the help of the lights reflected from the cushioning roller member 200*a* at night as the reflectors are inputted into the binder.

Figure 31:
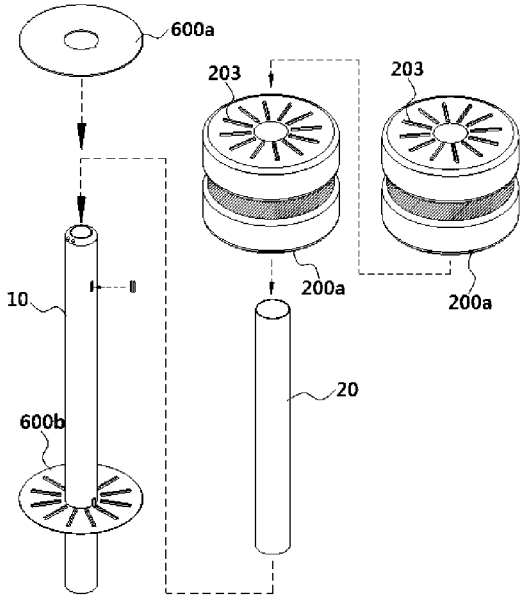
FIG. 31 is a view of a construction that a cushioning roller member with a second protrusion is assembled in a cushioning roller member of an impact absorption facility for road.
Figure 32:
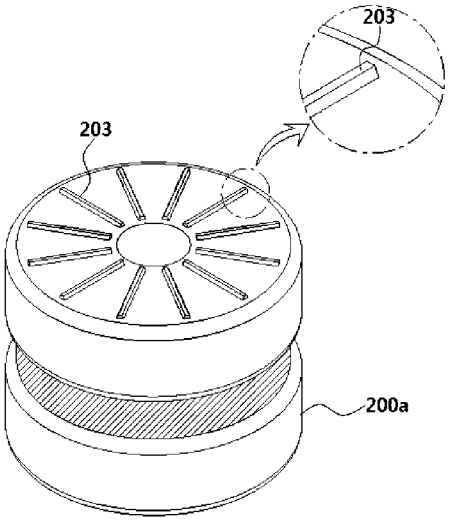
FIG. 32 is a partially enlarged view of a second protrusion formed on the upper surface of a cushioning roller member of a cushioning roller member of an impact absorption facility for road according to the present invention.

As shown in FIGS. 31 and 32, a plurality of second protrusions 203 are upwards protruded in radial shapes from the upper and lower surfaces of the cushioning roller member 200*a*, and a first rotation block plate 600*a* is formed on the upper side of the pile 10, and a second rotation block plate 600*b* is formed on the lower side of the same.

The radial second protrusions 203 protruded from the cushioning roller member 200*a* are engaged with the first protrusions 603 of the first and second rotation block plates 600*a* and 600*b*, so rotation speed can be reduced when a vehicle collides.

Figure 33:
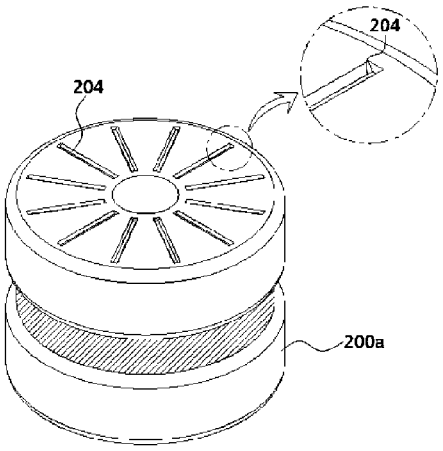
FIG. 33 is a partially enlarged view of a second engaging groove formed on the upper surface of a cushioning roller member of an impact absorption facility for road according to the present invention.

As shown in FIG. 33, instead of installing the cushioning roller member 200*a* with the second protrusions 203, a plurality of second engaging grooves 204, concaved downwards, can be formed in radial shapes in the upper and lower surfaces of the cushioning roller member 200*a*, so the first protrusions 603 formed in one surface of the first and second rotation block plates 600*a* and 600*b* are engaged with the second engaging grooves 204 formed in the upper and lower surfaces of the cushioning roller member 200*a*. When the cushioning roller member 200*a* rotates, the first protrusions 603 are inserted into or escaped from the second engaging grooves 204 while continuously rotating, so it is possible to further decrease the rotation speed.

Figure 34:
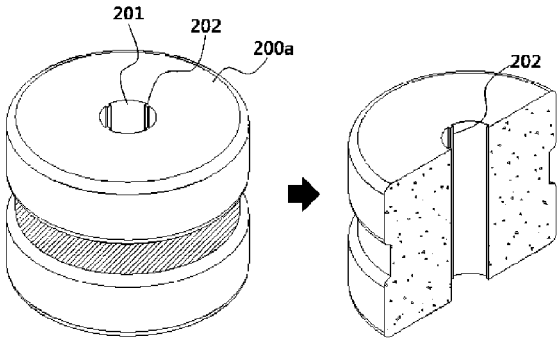
FIG. 34 is a partially enlarged view of a first engaging protrusion formed in an engaging member of a cushioning roller member of a cushioning roller member of an impact absorption facility for road according to the present invention.
Figure 35:
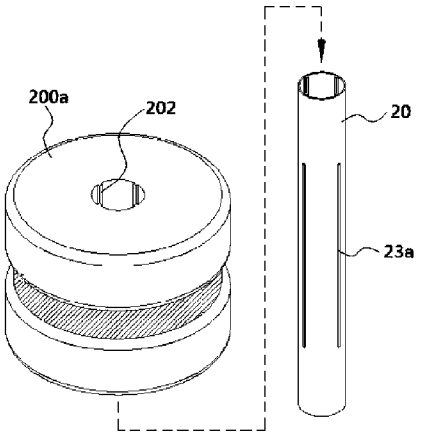
FIG. 35 is a view of a construction engaged with a rotation support pipe having a second engaging protrusion in a cushioning roller member of FIG. 34 according to the present invention.

As shown in FIGS. 34 and 35, the cushioning roller member 200*a* includes a plurality of first engaging protrusions 202 protruded from the inner surface of the engaging member 201 and formed in the vertical direction of the engaging member 201, and a plurality of second engaging protrusions 23*a* are vertically and longitudinally protruded from the outer surface of the rotation support pipe 20. So, when a vehicle collides, the second engaging protrusions 23*a* formed on the outer surface of the rotation support pipe 20 and the first engaging protrusions 202 formed in the inner surface of the engaging member 201 of the cushioning roller member 200*a* are engaged with each other and rotate for thereby reducing the rotation speed.

Figure 36:
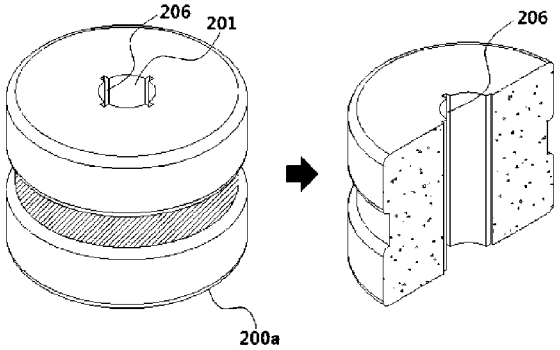
FIG. 36 is a partially enlarged view of a construction that a third engaging groove is formed in an engaging member of a cushioning roller member of a cushioning roller member of an impact absorption facility for road according to the present invention.

As shown in FIG. 36, instead of installing the first engaging protrusions 202 of the cushioning roller member 200*a*, third concave engaging grooves 206 can be formed in the inner surface of the engaging member 201, so the second engaging protrusions 23*a* formed in the outer side of the rotation support pipe 20 are repeatedly inserted into and escaped from the third engaging grooves 206 formed in the inner surface of the engaging member 201 of the cushioning roller member 200*a* and rotate for thereby decreasing the rotation speed of the cushioning roller member 200*a*, so it is possible to obtain an impact release effect of a vehicle and make the vehicle enter the normal runway.

Figure 37:
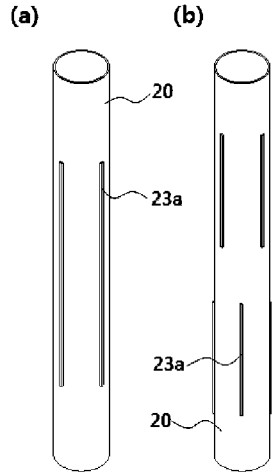
FIG. 37 is a view of a construction that a second engaging protrusion "a" and "b" are formed on a rotation support pipe of an impact absorption facility for road according to the present invention.

As shown in FIG. 37B, the second engaging protrusions 23*a* are installed on the outer surface of the rotation support pipe 20 in zigzag shapes at regular intervals, so the first engaging protrusion 202 or the third engaging grooves 206 formed in the inner surface of the engaging member 201 of the cushioning roller member 200*a* are engaged or collide with the second engaging protrusions 23*a* formed in zigzag shapes in the outer surface of the rotation support pipe 20. So, the cycle for blocking the rotation of the cushioning roller member 200*a* is shortened, and a certain difference is made in the rotation speeds between the upper and lower sides of the cushioning roller member 200*a* for thereby decreasing the rotation speed.

Figure 38:
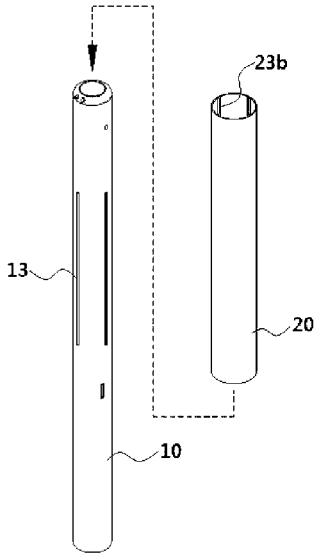
FIG. 38 is a view of a construction assembled with a rotation support pipe with a second engaging protrusion in a pile having a third engaging protrusion in an impact absorption facility for road according to the present invention.

As shown in FIG. 38, a vertically and longitudinally protruded third engaging protrusion 13 is formed in an outer side of the pile 10, and a vertically and longitudinally protruded second engaging protrusion 23*b* is formed in an inner surface of the rotation support pipe 20. The third engaging protrusion 13 formed in the outer side of the pile collides with the second engaging protrusion 23*b* formed in the inner surface of the rotation support pipe 20 for thereby decreasing the rotation speed of the rotation support pipe 20.

Figure 39:
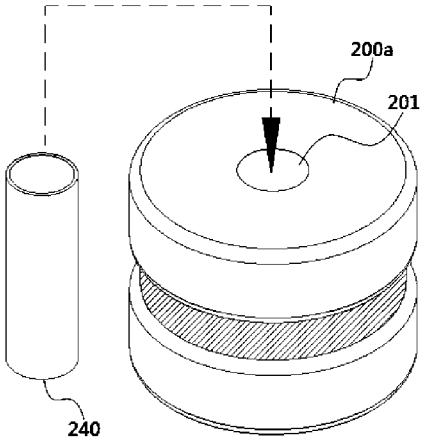
FIG. 39 is a view of an assembled construction that a reinforcing pipe is installed in an engaging member of a conventional cushioning roller member according to the present invention.
Figure 40:
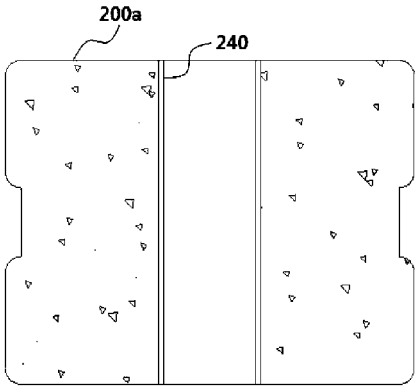
FIG. 40 is a cross sectional view of a construction that a reinforcing pipe of FIG. 39 is installed in an engaging member of a cushioning roller member.

As shown in FIGS. 39 and 40, there is shown a conventional structure in which the reinforcing pipe 240 is engaged with the engaging member 201 of the cushioning roller member 200*a*. A reinforcing pipe 240 is installed to enhance a rotational force of the cushioning roller member 200*a* by increasing the friction force with the rotation support pipe 20 or the pile 10 and to obtain a perfect formality of the engaging member 201 of the cushioning roller member 200*a*.

In addition, after a foam polymer is filled in the forming mold after the reinforcing pipe 240 is installed in the forming mold of the cushioning roller member when fabricating the cushioning roller member 200*a* for thereby forming a cushioning roller member 200*a*. At this time, the engaging member 201 is formed in the center of the cushioning roller member 200*a* with the help of the reinforcing pipe 240.

In the structure of the cushioning roller member 200*a* that the reinforcing pipe 240 is further formed in an outer surface of the engaging member 201, the rotation support pipe 20 or the pile 10 is inserted and installed through the inner side of the reinforcing pipe 200*a*, and the cushioning roller member 200*a* filled as a polymer is foamed with the help of sunshine is contracted or expanded, by which pores are formed, so the reinforcing pipe 201 could escape.

In the above case, when a vehicle collides, a repulsive force is formed with respect to the rotation of the cushioning roller member 200*a*, so the rotation speed cannot be controlled, and a driver cannot prevent accidents.

Figure 41:
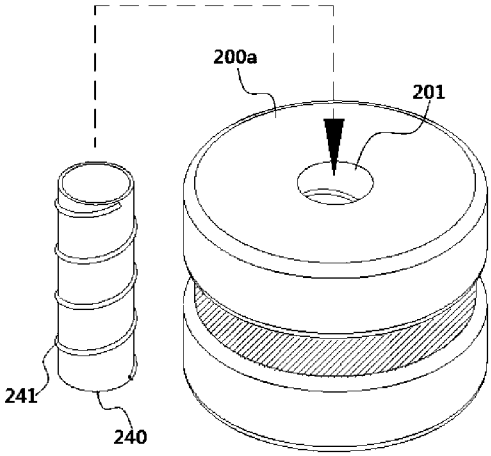
FIG. 41 is a view of an assembled construction that a reinforcing pipe with male threads is installed in an engaging member of a cushioning roller member in an impact absorption facility for road according to the present invention.
Figure 42:
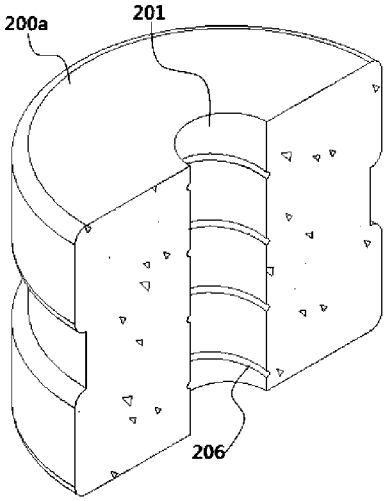
FIG. 42 is a cross sectional view of a construction that female threads are formed in an engaging member of a cushioning roller member and are engaged with the male threads of the reinforcing pipe in an impact absorption facility for road according to the present invention.

As shown in FIGS. 41 and 42, a reinforcing pipe 240 is further formed in the engaging member 201 of the cushioning roller member 200*a*, and a male thread 241 is formed on an outer surface of the reinforcing pipe 240, and a female thread 206 is formed on the engaging member 201 of the cushioning roller member 200*a*.

The reinforcing pipe 240 with the male thread 241 in its outer surface is engaged with the engaging member 201 of the cushioning roller member 200*a* with the female thread 106, so that it is possible to prevent escape with the help of stronger contacting force and engaging force even when the foamed polymer is contracted or expanded.

Figure 43:
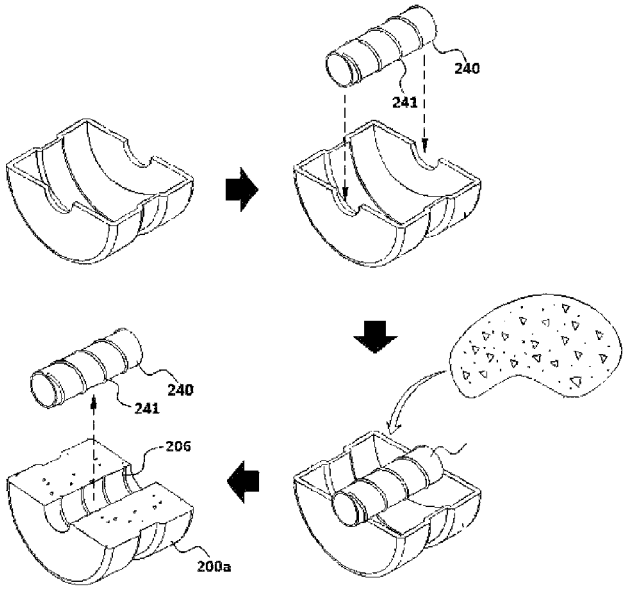
FIG. 43 is a process that a cushioning roller member with a reinforcing pipe is manufactured in an impact absorption facility for road according to the present invention.

As shown in FIG. 43, when the female thread 206 formed in the engaging member 201 of the cushioning roller member 200*a* is formed by inputting foam polymer after the reinforcing pipe 240 with the male thread 241 is installed before the foam polymer is inputted into the forming mold of the cushioning roller member 200*a*, the female thread 206 is formed in the inner surface of the engaging member 201 by means of the male thread 241 of the reinforcing pipe 241, and the outer surface of the reinforcing pipe 240 is engaged with the inner surface of the engaging member 201 through the female and male threads 206 and 241, whereby it is possible to manufacture a cushioning roller member 200*a* with a strong engagement force.

The method for manufacturing the cushioning roller member 200*a* includes a step for installing a reinforcing pipe 240 with a male thread 241 in a forming mold of the cushioning roller member 200*a*, a step for inputting a foam polymer after the reinforcing pipe 240 is installed, and a step for foaming and forming the foam polymer for thereby manufacturing the cushioning roller member 200*a*.

Figure 44:
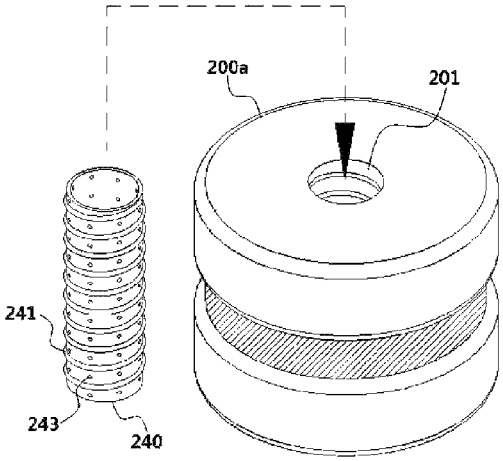
FIG. 44 is a view of an assembled construction that a reinforcing pipe with a second through hole is installed in an impact absorption facility for road according to the present invention.

As shown in FIG. 44, a second through hole 243 is further formed on an outer surface of the reinforcing pipe 240, so a stronger and more reliable contacting force with the inner surface of the engaging member 201 can be obtained for thereby preventing the escape of the reinforcing pipe 240.

Figure 45:
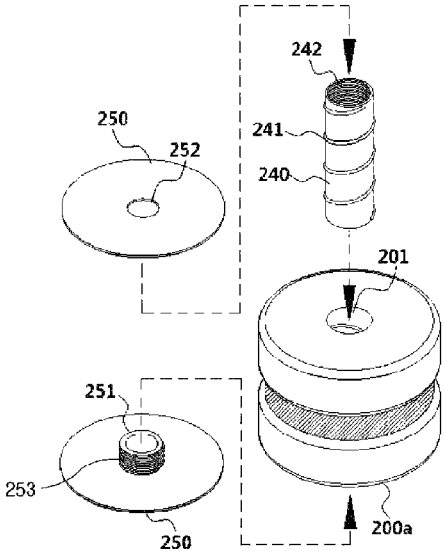
FIG. 45 is a view of an assembled construction that a reinforcing cap is installed in the upper and lower surfaces of a cushioning roller member with a reinforcing pipe in an impact absorption facility for road according to the present invention.

As shown in FIG. 45, the threads 242 is formed in the upper and lower inner surfaces of the reinforcing pipe 240 and are engaged with the engaging member 201 of the cushioning roller member 200*a*, and the threads 253 are formed on the upper and lower surfaces of the cushioning roller member 200*a* and are engaged with the threads formed in the inner surface of the reinforcing pipe 240, so that the reinforcing cap 250 with the reinforcing shoulder 251 having a through hole 252 is formed.

In the above structure, the reinforcing cap 250 is engaged to the reinforcing pipe 240, so it is possible to substantially prevent the escape of the reinforcing pipe 240.

Figure 46:
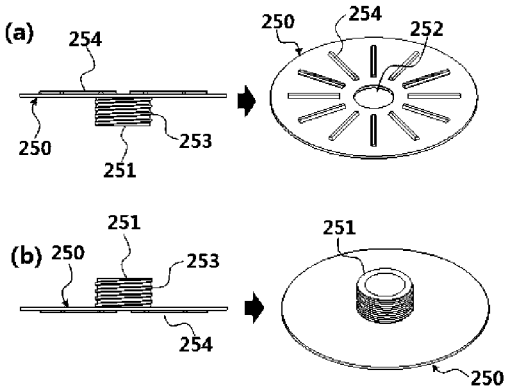
FIG. 46 is a view of a construction that a third protrusion is formed on the upper surface of a reinforcing cap in an impact absorption facility for road according to the present invention.

As shown in FIG. 46, a radial shaped third protrusion 254 is formed on an upper surface of the reinforcing cap 250, so the first rotation block plate 600*a* installed in the upper side of the pipe 10 and the second rotation block plate 600*b* installed in the lower side of the pile 10 make it possible to decrease the rotation speed of the cushioning roller member 200*a*.

Figure 47:
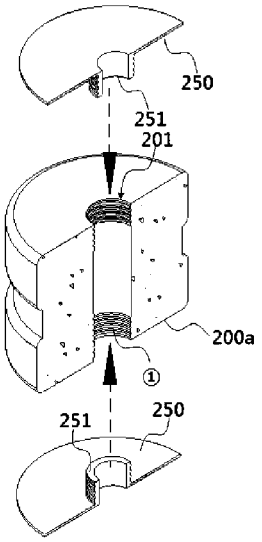
FIG. 47 is a cross sectional view of a construction that a reinforcing cap is installed in the threads formed in an engaging member of a cushioning roller member in an impact absorption facility for road according to the present invention.

As shown in FIG. 47, instead of installing the reinforcing pipe 240 of the cushioning roller member 200*a*, the threads (1) are formed on the upper and lower sides of the inner surface of the cushioning roller member 200*a*, so that the reinforcing cap 250 is engaged with the help of the threads (1) formed in the inner surface of the engaging member 201, while maintaining a pipe shape of the engaging member 201 as well as increasing the friction force of the pile 10 or the rotation support plate 20 for thereby enhancing the rotational force.

Figure 48:
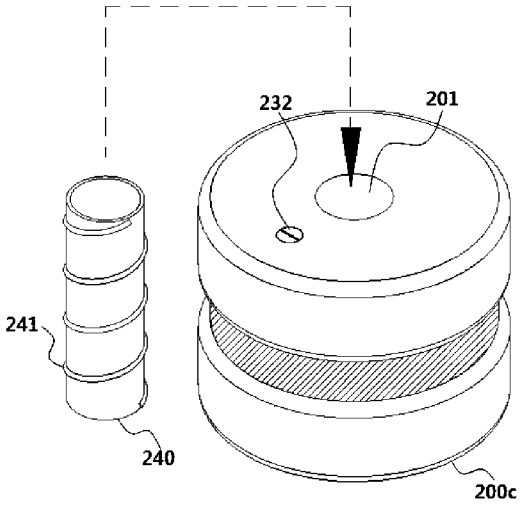
FIG. 48 is a view of an assembled construction that a reinforcing pipe is installed in an engaging member of a cushioning roller member with a space part in an impact absorption facility for road according to the present invention.
Figure 49:
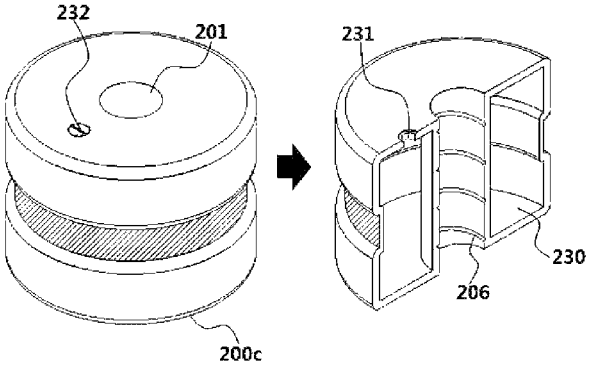
FIG. 49 is a perspective cross sectional view of a cushioning roller member in an impact absorption facility for road of FIG. 48 according to the present invention.

As shown in FIGS. 48 and 49, a cushioning roller member 200*c* is configured in such a manner that a space part 230 is formed in the interior of the cushioning roller member 200*c*. An inlet port 231 stopped by the stopper 232 is formed on an upper side of the cushioning roller member 200*c*.

A female thread 206 is formed in the engaging member 201 of the cushioning roller member 200*c*, and a reinforcing pipe 240 with a male thread 241 is formed in an outer surface and is engaged with the female thread 206 formed in the engaging member 201, so that the rotation force of the cushioning roller member 200*c* is enhanced, and the transformation of the engaging member 201 is prevented when a vehicle collides.

Figure 50:
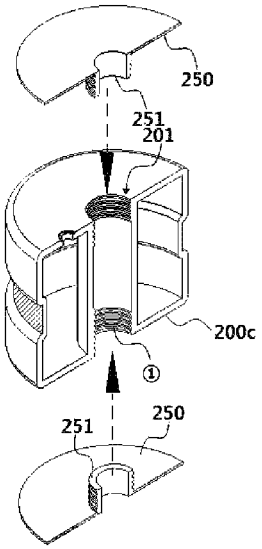
FIG. 50 is a cross sectional view of a construction that a reinforcing cap is installed in the engaging member of a cushioning roller member with a space part in its interior in an impact absorption facility for road according to the present invention.

As shown in FIG. 50, in the bubble type cushioning roller member 200*c*, the threads (1) are formed in the upper and lower sides of the inner surface of the cushioning roller member 200*c*, and the reinforcing cap 250 is engaged with the help of the threads (1) of the engaging member 201, so the transformation of the engaging member 201 can be prevented, and the rotational force with respect to the pile 10 or the rotation support pipe 20 can be enhanced.

Figure 51:
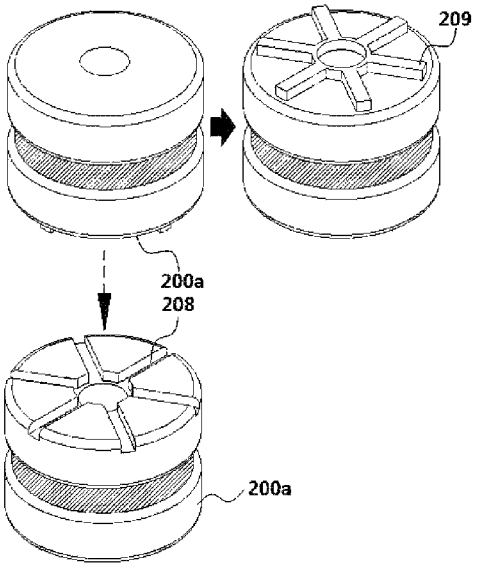
FIG. 51 is a view of an assembled construction of a cushioning roller member with a female/male engaging member in an impact absorption facility for road according to the present invention.
Figure 52:
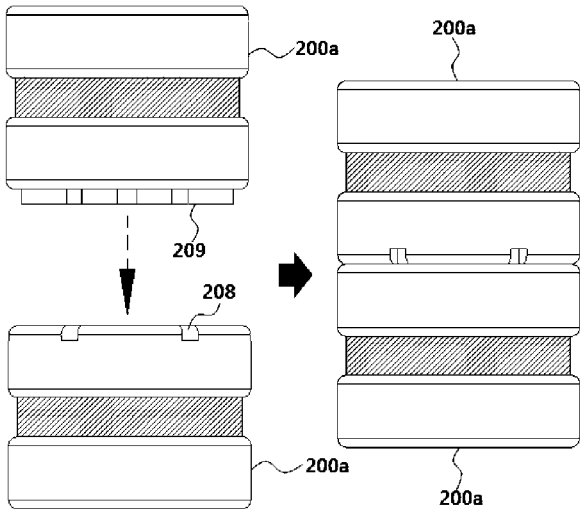
FIG. 52 is a front view of an assembling state based on the construction of FIG. 51.

As shown in FIGS. 51 and 52, a male engaging member 209 is formed in a lower surface of the cushioning roller member 200*a*, and a female engaging member 208 is formed in an upper surface of another cushioning roller member 200*a*. When it is inserted into the pipe 10 or the rotation support pipe 20, a much stronger can be obtained with the help of the engagement between the female and male engaging members 208 and 209 of each cushioning roller member 200*a*, and since it rotates when a vehicle collides, more reliable impact releasing effect can be obtained.

Figure 53:
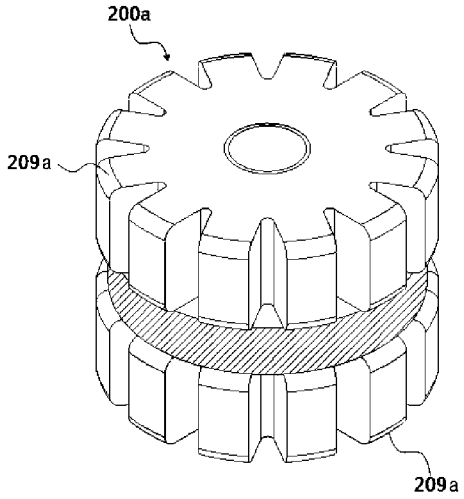
FIG. 53 is a perspective view of a cushioning roller member with a protrusion on an outer surface in an impact absorption facility for road according to the present invention.

As shown in FIG. 53, a plurality of protrusions 209*a* are formed in radial shape from an outer surface of the cushioning roller member 200*a*. When the cushioning roller member 200*a* with a plurality of protrusions 209*a* is installed in a road, another cushioning roller member 200*a* is installed in the pile 10 with the cushioning roller member 200*a*, so the pile 10 with the cushioning roller member 200*a* is installed in one pair in the road, and the cushioning roller members 200*a* are surface-contacted with each other.

With the toothed structure formed as the protrusions 209 are engaged, the rotation force can be reduced with the help of the protrusions 209*a* when a vehicle collides, so an impact release effect can be obtained.

Figure 54:
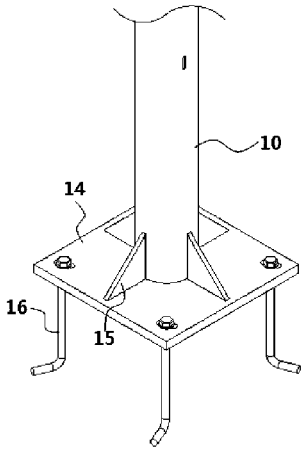
FIG. 54 is a view of an assembled construction of a lower side of a pile fixed on the ground in an impact absorption facility for road according to the present invention.
Figure 55:
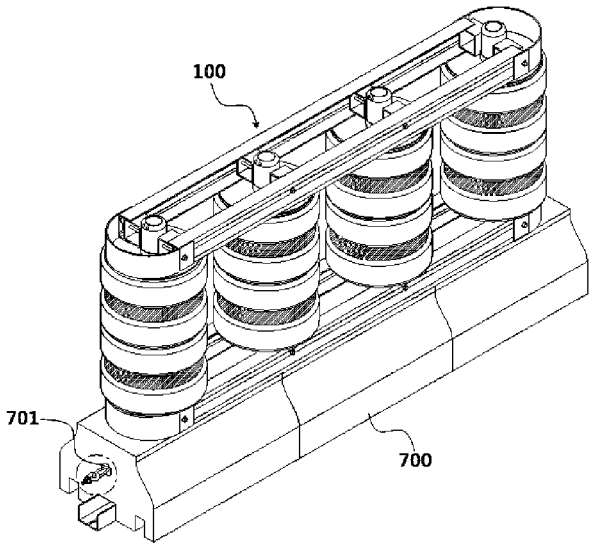
FIG. 55 is a perspective view of a construction that an impact absorption facility for road is fixed to a lower side of a pile using a concrete block according to the present invention.
Figure 56:
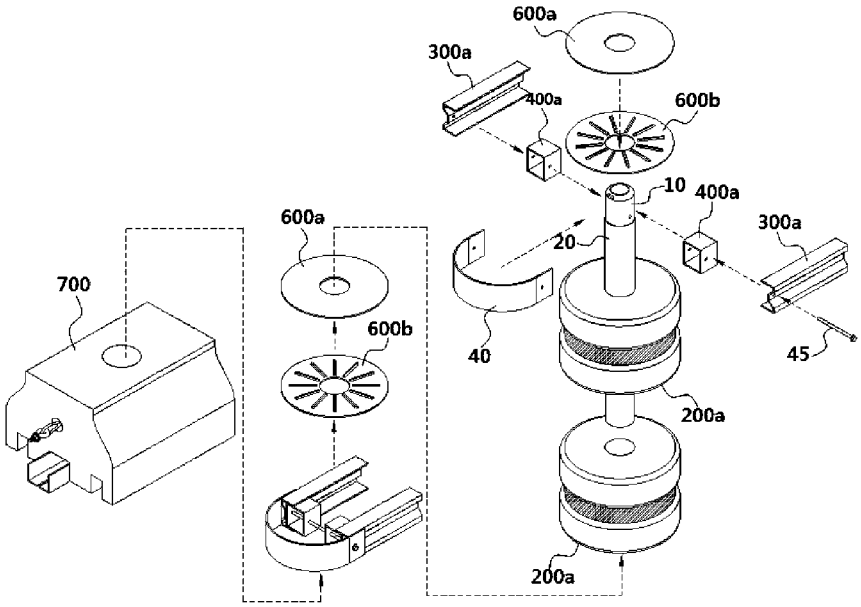
FIG. 56 is a disassembled perspective view of an impact absorption facility for road and a concrete block according to the present invention.
Figure 57:
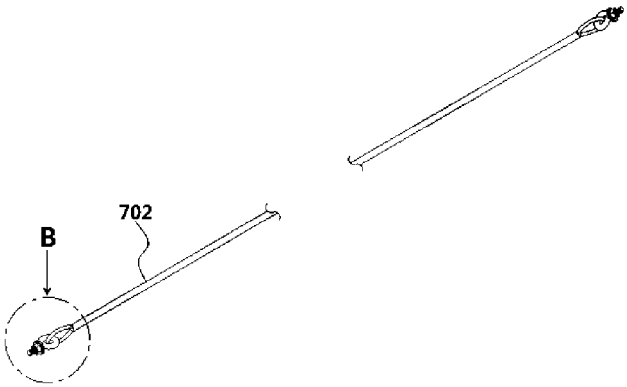
FIG. 57 is a view of a construction of a wire rope which connects concrete blocks in an impact absorption facility for road according to the present invention.

As shown in FIG. 54, when the pile 10 is fixed on the ground, a base plate 14 is installed in a lower side of the pile, and the lower side of the pile 10 is fixed at the center of the base plate 14, and a plurality of reinforcing ribs 15 are installed on the outer surface of the pile 10 at regular intervals in order for the lower outer surface of the pile 10 and one surface of the base plate 14 to be related with each other.

The base plate 14 fixed by the pile 10 is installed on the ground and is fixed by the anchor bolt 16 along the edges of the base plate 14.

As shown in FIGS. 55 to 59, instead of fixing the pile 10 on the ground, the pile 10 can be fixed by installing a plurality of concrete blocks 700 in the lower side of the impact absorption facility 100 for road. When the concrete blocks 700 are connected, a wire rope 702 is connected through an engaging hole 701 passing through the lower side of the concrete block 700, and the end of the wire rope 702 is fixed in the eye bolt 703, and the washer 704 and the nut 705 are engaged to the eye bolt 703 for thereby closely contacting the concrete blocks 700.

The concrete blocks 700 can operate as a median strip of roads, and the impact absorption facility 100 is installed on the upper side of the concrete blocks 700.

Figure 58:
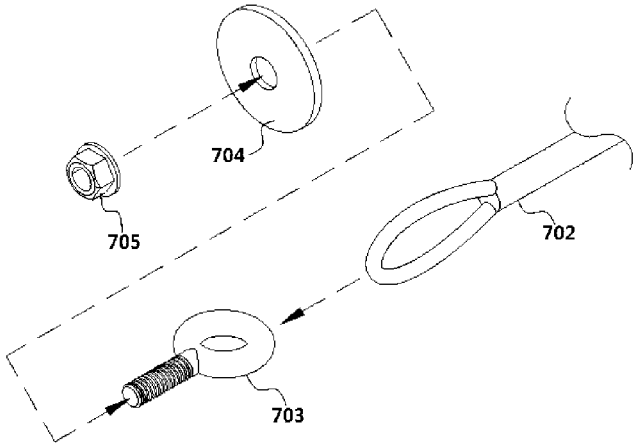
FIG. 58 is a view of an assembled construction engaged to an engaging hole of a concrete block of the section B of FIG. 57.
Figure 59:
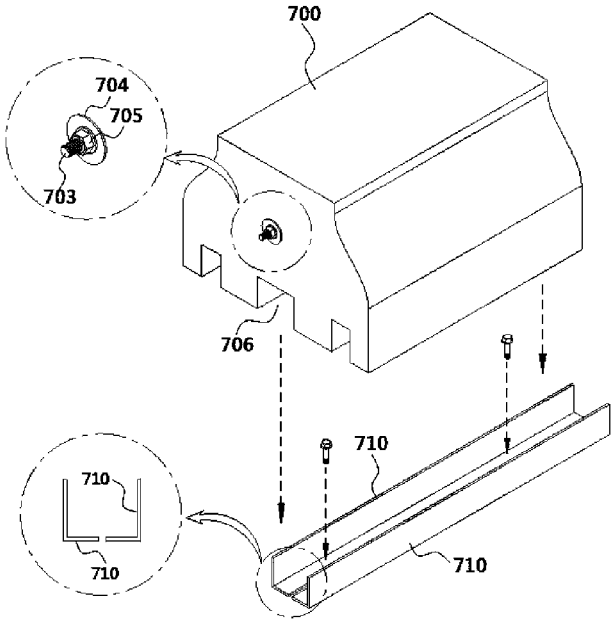
FIG. 59 is a view of a construction that an escape prevention fixing piece is assembled to an engaging groove formed in a lower side of a concrete block.

As shown in FIGS. 58 and 59, when the concrete blocks 700 are installed, a wire rope 702 is connected through an engaging hole 701 passing through the lower side of the concrete block 700, and an end of the wire rope 702 is fixed to the eye bolt 703, and the washer 704 and the nut 705 are engaged to the eye bolt for thereby closely contacting the concrete blocks 700.

The washer 704 is configured not to pass through the engaging hole 701. The nut 705 is engaged to the eye bolt 703 fixed by the wire rope 702, so a strong contacting force can be obtained between the concrete blocks 700, and the escapes of the concrete blocks 700 can be prevented when a vehicle collides.

As shown in FIG. 59, a hook groove 706 is longitudinally formed in the center of the lower side of the concrete block 700. When inserted into the hook groove 706, one pair is provided so that the escape prevention fixing pieces 710 are opposite to each other with its cross section being formed in an L shape for thereby more reliably preventing the escapes of the concrete blocks 700. As the escape prevention fixing pieces 710 are symmetrically installed by one pair, it is possible to adjust the width of the hook groove 706 of the concrete blocks 700 and the width of a pair of the escape prevention fixing pieces 710 being opposite depending on the line shape of the road.

When the width of the hook groove 706 is wide, the outer surfaces of a pair of the escape prevention fixing pieces 710 surface-contact by spacing the escape prevention fixing pieces 710, so the width of the escape prevention fixing pieces 710 can be adjusted depending on the width of the hook groove 706 for thereby obtaining a stable and reliable engagement of the concrete blocks with respect to the ground while preventing an accident with the help of resisting force generated in the concrete blocks 700 when a vehicle collides.

Figure 60:
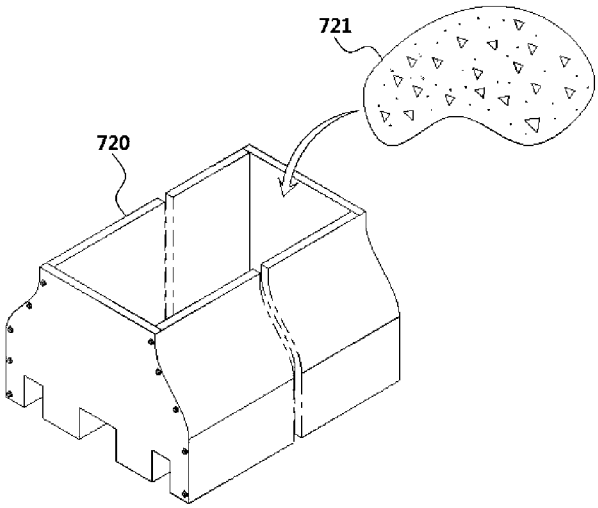
FIG. 60 is a view of a construction that mixed concrete is cast by installing a frame at the site so as to manufacture concrete blocks.

As shown in FIG. 60, when the concrete blocks 700 are installed on the ground, prefabricated concrete blocks 700 can be installed, but the concrete blocks can be manufactured at site, and the frames 720 for concrete blocks are installed on the road with certain lengths, and the concrete 721 is cast into the interior of the frames 720, and the frames 720 are removed after a certain curing period pass for thereby manufacturing the concrete blocks 700 at site.

Here, the frames 720 for concrete blocks are longitudinally prepared on the ground of the road, namely, an integral frame 720 with a size corresponding to the size when a plurality of concrete blocks 700 are connected in series is installed on the road, and the concrete 721 is cast into the interior of the frame 720 for thereby manufacturing a lengthy concrete block.

Figure 61:
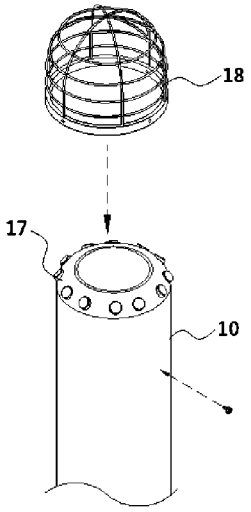
FIG. 61 is a view of a construction that a LED solar cell and a cover part are assembled to an upper side of a pile of an impact absorption facility for road according to the present invention.

As shown in FIG. 61, a LED solar cell 17 automatically controlled is installed on the upper surface of the frame 720. In addition, there is provided a net shaped cover part 18 which covers the LED solar cell and fixed on an outer side of the pile 10.

Figure 62:
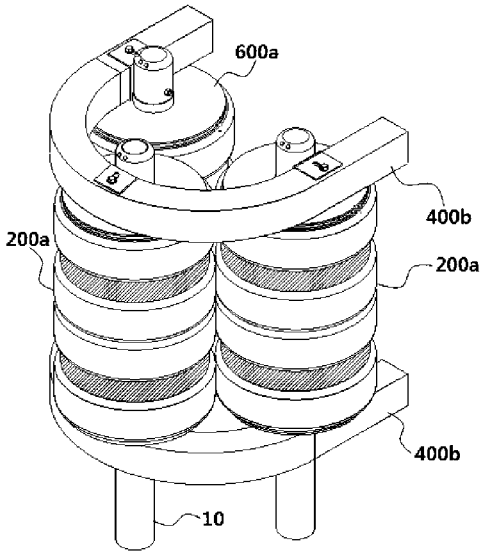
FIG. 62 is a perspective view of another assembling structure of an impact absorption facility for road according to the present invention.

As shown in FIG. 62, the first and second rotation plates 600*a* and 600*b* and the cushioning roller member 200*a* are installed in the pile 10 on the road, and a pair of opposite piles 10 equipped with the first and second rotation block plates 600*a* and 600*b* and the cushioning roller member 200*a* are in series installed at the rear side of the installed piles 10, and rectangular pipe shaped impact absorption plates 400*b* are integrally installed in the outer surface of the upper and lower sides of the pile 10 and are connected with each other.

Figure 63:
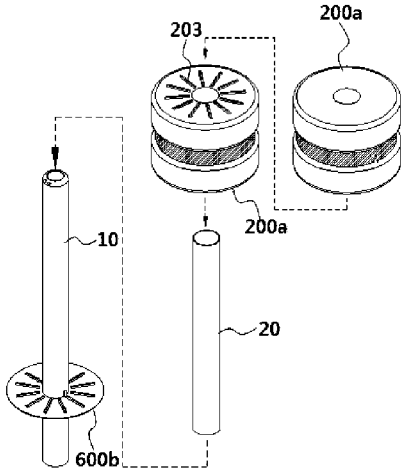
FIG. 63 is a view of an assembled construction that a rotation support pipe with a cushioning roller member is installed in a pile in an impact absorption facility for road according to the present invention.
Figure 64:
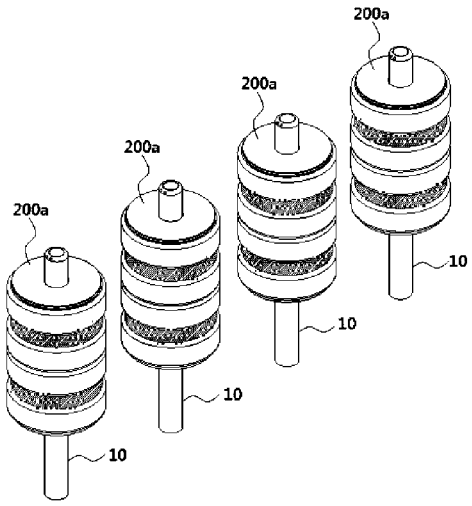
FIG. 64 is a view of a construction that an assembled structure of FIG. 63 is installed on the ground.

As shown in FIGS. 63 and 64, the second rotation block plate 600*b* is installed in the lower side of the pile 10, and the rotation support pipe 20 equipped with the cushioning roller member 200*a* having the second protrusion 203 or the second engaging groove 204*b* is inserted in the upper and lower sides of the pile 10, so it can be installed as a safety facility in a leisure resort such as an ice skate site, a ski resort, etc. for thereby reducing the damages of persons.

Figure 65:
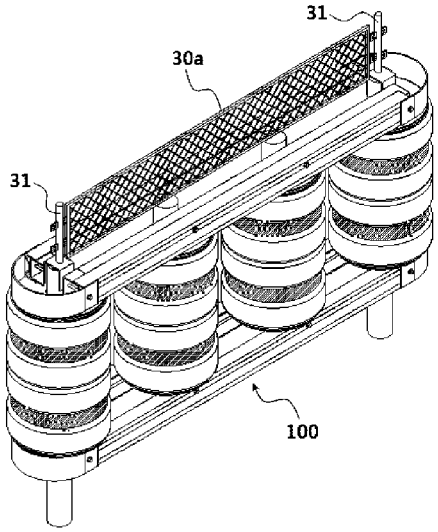
FIG. 65 is a perspective view of a construction that a sun visor net is installed in an impact absorption facility for road according to the present invention.
Figure 66:
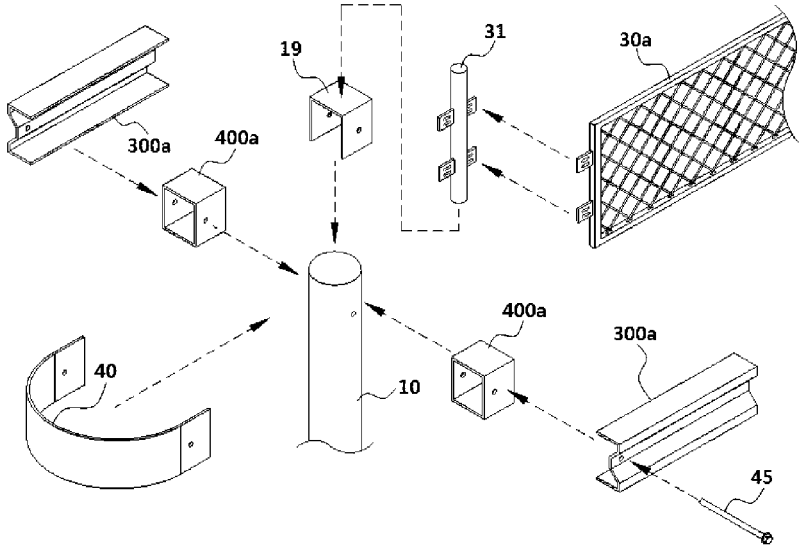
FIG. 66 is a disassembled perspective view of a construction that a sun visor net is installed in an impact absorption facility for road according to the present invention.

As shown in FIGS. 65 and 66, a sun visor net 30*a* is installed in each pile positioned at both sides of the impact absorption facility 100 while connecting their top ends, and the clamps 19 with vertical cross sections are engaged to the upper sides of the piles 10 using the bolts 45 when installing the safety rail 300*a* and the impact absorption plate 400*a*, and the sun visor pile 31 is fixed on the upper surface of the clamp 19, and the sun visor net 30*a* is installed in one side of the sun visor pipe 31. So, the sun visor net 30*a* connecting the piles of both sides of the impact absorption facility 100 can be finished.

The impact absorption facility 100 for road with the sun visor net 30*a* can be used as a median strip of the road.

Figure 67:
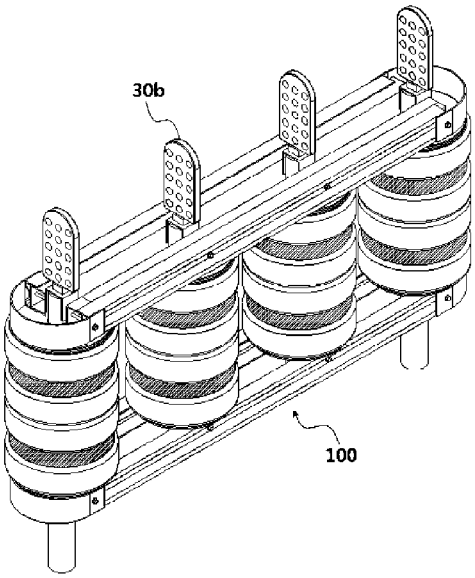
FIG. 67 is a perspective view of a construction that a sun visor is installed in an impact absorption facility for road according to the present invention.

As shown in FIG. 67, instead of the sun visor net 30*a*, the punched sun visor plates 30*b* can be installed in every pile of the impact absorption facility for road.

Figure 68:
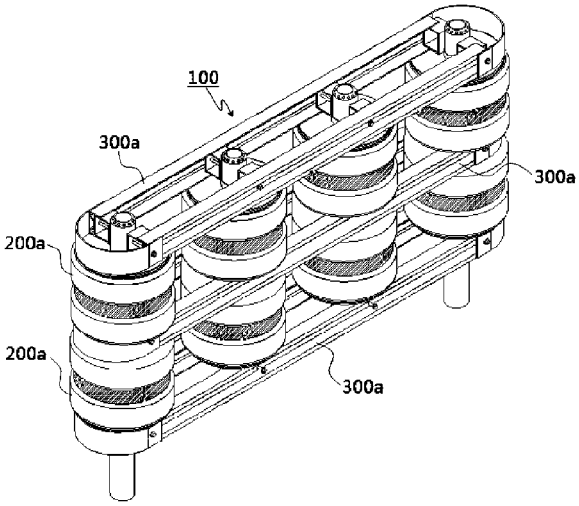
FIG. 68 is a perspective view of a construction that a safety rail is installed with a three-stage structure in an impact absorption facility for road according to the present invention.

As shown in FIG. 68, the safety rail 300*a* is installed in the upper and lower sides of the pile 10, and the safety rail is further installed between the cushioning roller members 200*a* for thereby reliably preventing the impacts when a vehicle collides. As a result, it is possible to minimize the damages of the vehicle and the passenger by preventing the escapes of the elements belonging to the impact absorption facility 100 for roads. A plurality of safety rails 300*a* can be installed at regular intervals. The cushioning roller member 200*a* can be installed between the safety rails 300*a*.

Figure 69:
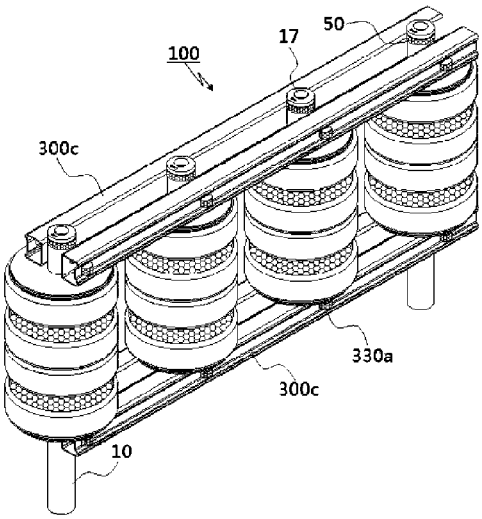
FIG. 69 is a perspective view of a construction that a safety rail and a rail cap are installed in an impact absorption facility for road according to the present invention.
Figure 70:
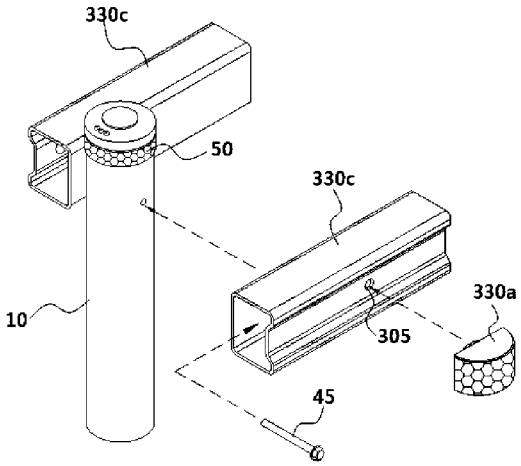
FIG. 70 is a view of a construction that pile-safety rail-rail cap are assembled in an impact absorption facility for road according to the present invention.
Figure 71:
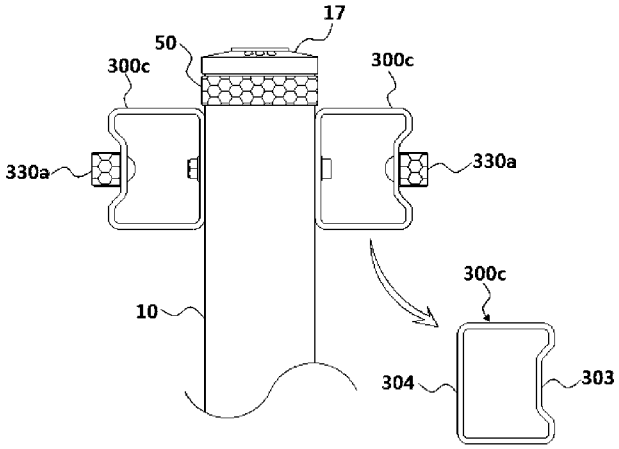
FIG. 71 is a cross sectional view of a construction that the pile-safety rail-rail cap of FIG. 70 are assembled.

As shown in FIGS. 69 and 71, the rotation support pipe 20 equipped with the cushioning roller member 200*a* can be inserted into the pile 10, and the safety rails 300*c* are installed at both sides of the upper and lower side of the pile 10. In the above structure, the safety rail 300*c* includes a rail guide 303 which is concave in a longitudinal direction and is formed in one side surface of the same and a contact guide 304 which is formed in the other side surface of the same and of which upper and lower sides are vertically extended. The engaging grooves 305 are formed in the rail guide 303 of the safety rail 300*c* at regular intervals, and the rail cap 330*a* is engaged to the engaging groove 305.

When the safety rail 300*c* is engaged to the pile 10, the bolts 45 are engaged to the contact guide 304 and pass through the contact guide 304 of another safety rail 300*c* formed in the rear side of the pile 10 and is engaged with the nuts.

In the above structure, when a vehicle collides with the safety rail 300*c*, since the bolts 45 are protruded from the outer side of the rail guide 303 in the contact guide 304, by which an elastic force needed for reducing the impacts might be decreased, so it is needed to engage the pile 10 and the contact guide 304 of the safety rail 300*c* on the safety rail 300*c* in order to obtain the impact reducing effects.

Figure 72:
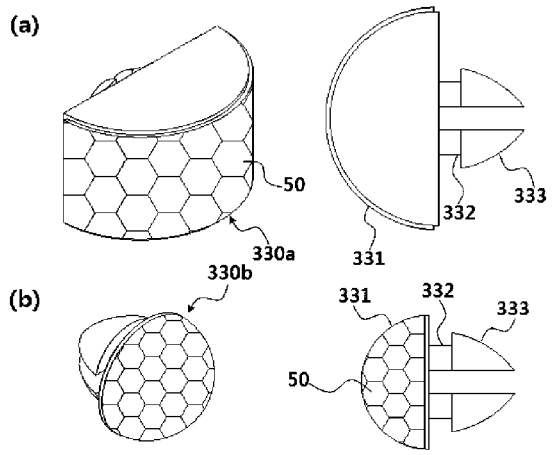
FIG. 72 is a view of a construction of rail caps "a" and "b" assembled to a safety rail of an impact absorption facility for road according to the present invention.

As shown in FIG. 72A, the rail cap 330*a* engaged to the engaging groove 305 of the safety rail 300*c* is formed of a head part 331, and an engaging part 332 which is integrally extended from the lower surface of the head part 331, and an engaging shoulder 333 is formed at the end of the engaging part 332.

Here the head part 331 can be formed in various shapes and configurations. As shown in FIG. 72B, the head part 331 can form an eclipse rail cap 330*b*, and a separate reflection sheet 50 can be attached on the front surface of the head part 331, so the driver can have enhanced recognition ability. When the rail cap 330*a* is manufactured, the engaging shoulder 333 is manufactured by integrally injecting the engaging part 332 along with the head part 331.

As shown in FIG. 71, a reflection sheet 50 is attached on an outer surface of the upper side of the pile 10, namely, the reflection sheet 50 is attached to an outer surface of the upper side of the pile 10 exposed upwardly and equipped with the safety rail 300*c*, so that the driver can reliably recognize the impact prevention apparatus 100.

Figure 73:
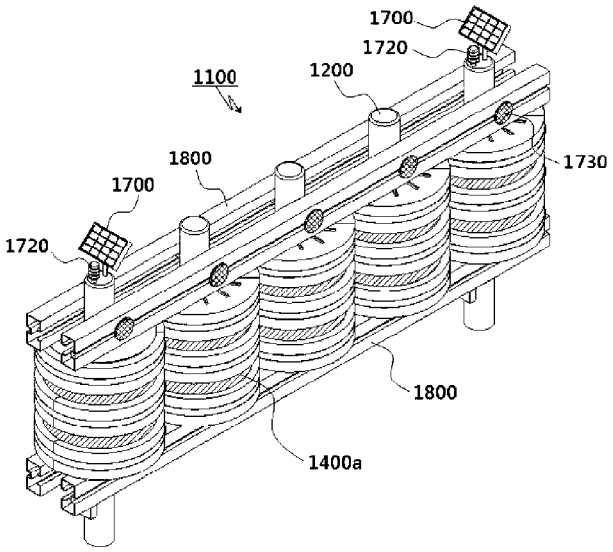
FIG. 73 is a view of an installed construction of an impact absorption facility for road according to the present invention.
Figure 74:
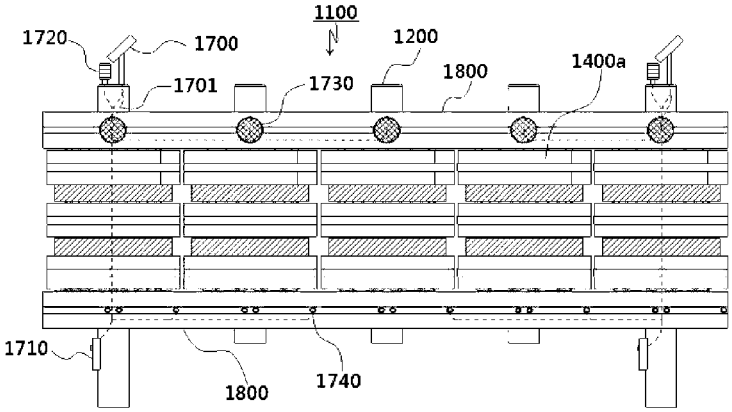
FIG. 74 is a cross sectional view of an installed construction of an impact absorption facility for road according to the present invention.

As shown in FIGS. 73 and 74, the present invention comprises a column shaped pile 1200 fixedly embedded in a centerline of the road or in a road side at regular intervals and a rotation support pipe 1300 which is rotatably engaged through the pile 1200.

The first and second casings 1410 and 1420 are formed in cylindrical shapes and are engaged to the outer surfaces of the rotation support pipe 1300, and the cushioning member 1430 is installed in the interior of each casing, with a plurality of high luminance reflection bands 1600 being installed on the outer sides of the casings, and the impact absorption member 1400*a* has an insertion hole at the center of the same.

A safety fence 1800 is positioned in the upper and lower sides of the impact absorption member 1400 and is horizontally and integrally installed at both sides of the upper and lower side of the pile 1200.

The pile 1200 comprises a rotation block plate 1500 at its lower side, and the rotation block plate 1500 includes an engaging hole 1520 in its center portion and is engaged to the pile 1200 and is mounted on the upper surface of the safety fence 1800 of the lower side, and a first fixing groove 120 is formed on one surface of the pile 1200, and a second fixing groove 1530 is formed in a portion of the inner surface of the engaging hole 1520 for being engaged by means of the fixing pin 1540, and a plurality of radial shaped protrusions 1510 are upwardly protruded from the upper surface.

The impact absorption member 1400*a* is mounted on the upper surface of the rotation block plate 1500, and the impact absorption member 1400*a* is engaged to the outer surface of the rotation support pipe 1300, and a plurality of protrusions 1421 are downwardly protruded from the lower surface of the second casing 1420.

Figure 75:
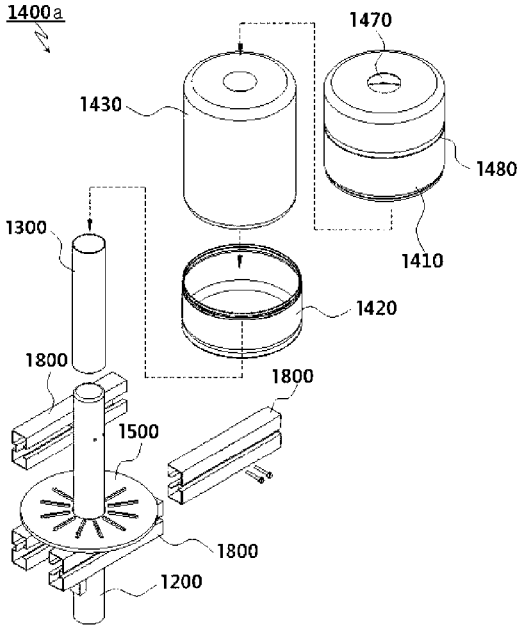
FIG. 75 is a disassembled perspective view of a construction that a pile is installed in an impact absorption member of an impact absorption facility for road according to the present invention.

As shown in FIG. 75, in the impact absorption member 1400*a*, the first and second casings 1410 and 1420 equipped with high luminance reflection bands 1600 in their outer sides and cushioning members 1430 in their inner sides are formed in cylindrical shapes and are rotatably engaged to the outer surface of the rotation support pipe 1300.

The cushioning member 1430 can be configured in a cylindrical shape by grinding waste tires or waste rubbers other than to use a high strength Styrofoam and urethane foam and by mixing urethane binder 10~20 weight % and filler 5~10 weight % to elastic chips 70~80 weight % of 3~5 mm sizes.

As shown in FIG. 75, the first and second casings 1410 and 1420 surrounding the inner cushioning member 1430 of the impact absorption member 1400*a* have elasticity like rubber materials, so no scraps such as chips are produced when a vehicle collides.

A ring shaped concave ring groove 1480 is formed on the outer surfaces of the first and second casings 1410 and 1420.

The high luminance reflection band 1400 is installed around the ring grooves 1480, so a driver can easily recognize.

As shown in FIG. 75, When installing the impact absorption member 1400*a*, the rotation support pipe 1300 engaged to an outer surface of the pile can freely rotate along the outer surface of the pile, and a vertical longitudinal insertion hole 1470 is formed in the center of the impact absorption member 1400*a*, and the insertion hole 1470 of the impact absorption member 1400*a* is engaged to the outer surface of the rotation support pipe 1300. The length of the rotation support pipe 1300 is in proportion to the length of the insertion hole 1470 of the impact absorption member 1400*a*.

Figure 76:
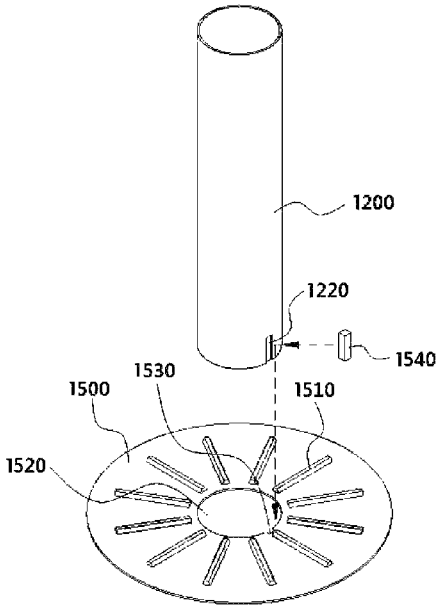
FIG. 76 is a view of a construction that a rotation block plate is installed in an impact absorption facility for road according to the present invention.
Figure 77:
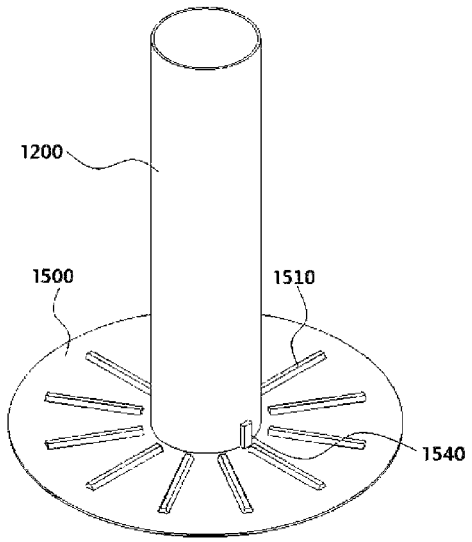
FIG. 77 is a perspective view of a construction that a rotation block plate is installed in a pile in an impact absorption facility for road according to the present invention.

As shown in FIGS. 76 and 77, a rotation block plate 1500 is engaged to the pile 1200 and is mounted on the upper side of the lower safety fence 1800 and a second fixing groove 1530 for fixing by means of the fixing pin 1540 as the first fixing groove 1220 is formed in one surface of the pile 1200, with a plurality of radial protrusions 1510 being upwards protruded from the upper surface.

When installing the rotation block plate 1500, a first fixing groove 1220 is formed in a lower surface of the pile 1200, and a second fixing groove 1530 is formed in an inner surface of the engaging hole 1520 formed in the center of the rotation block plate 1500, so the first fixing groove 1220 of the pile 1200 surface-contacts with the second fixing groove 1530 of the rotation block plate 1500. A fixing pin 1540 is closely contacted in the space in which the first and second fixing grooves 1220 and 1530 surface-contact for thereby fixing the rotation block plate 1500 at the lower side of the pile.

Figure 78:
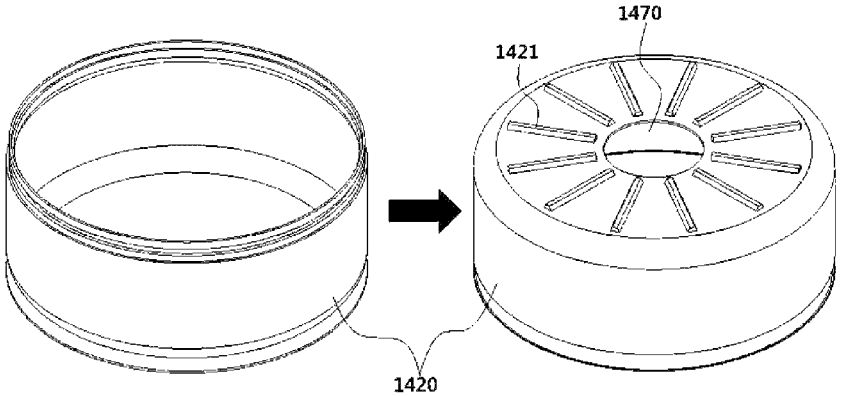
FIG. 78 is a lower side perspective view of a second casing of an impact absorption member of an impact absorption facility for road according to the present invention.
Figure 79:
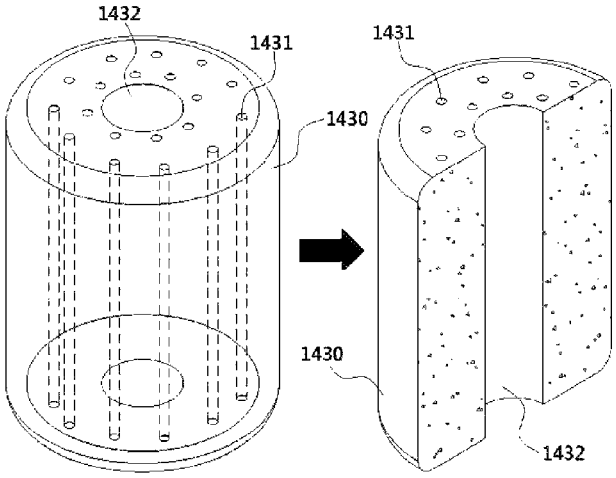
FIG. 79 is a view of a construction that a cushioning hole is formed in a cushioning member of an impact absorption facility for road according to the present invention.

As shown in FIG. 75 or 78, a plurality of downwardly protruded radial protrusions 1421 are protruded from the lower surface of the outer second casing 1420 of the impact absorption member 1400 which is formed in the outer surface of the rotation support pipe 1300 in the upper side of the rotation block plate 1500.

When installing the impact absorption member 1400*a* on the upper side of the rotation block plate 1500, the protrusion 1510 formed on the upper surface of the rotation block plate 1500 is deviated from the protrusion 1421 formed on the lower surface of the second casing 1420 provided in the impact absorption member 1400*a*.

Therefore, when a vehicle collides, the protrusion 1510 of the upper surface of the rotation block plate 1500 fixed in a lower side of the pile 1200 is engaged with the protrusion 1421 formed in a lower side of the second casing 1420 of the impact absorption member 1400 with the help of the accelerated rotational force of the impact absorption member 1400*a*, so the impact absorption member 1400*a* rotates. The rotation of the accelerated impact absorption member 1400*a* goes on slowly and finally stops.

Namely, when a vehicle collides with the impact absorption facility 1100 for road according to the present invention, the speed of the vehicle is gradually decreased, with the help of which a driver can stably change the running direction of the vehicle to a normal direction for thereby preventing an upside down collapse or escape of the vehicle. As shown in FIG. 77, a plurality of cushioning holes 1431 pass through the upper and lower surfaces of the inner cushioning member 1430 of the impact absorption member 1400*a*, so an impact reducing effect can be obtained with the help of the inner space of the cushioning member 1430, namely, the cushioning member 1431 when a vehicle collides.

Since the cushioning member 1430 is needed to first absorb the impacts applied to the driver of the vehicle at the moment of collision, a plurality of vertical cushioning holes 1431 are formed in the interior of the cushioning member 1430 in order to enhance the cushioning force and elastic force of the cushioning member 1430 for thereby more enhancing the impact absorption and elastic force of the cushioning member 1430.

The through hole 1432 passes through the upper and lower surfaces of the cushioning member 1430 and are engaged to the outer surface of the rotation support pipe 1300 through the pile 1200.

Figure 80:
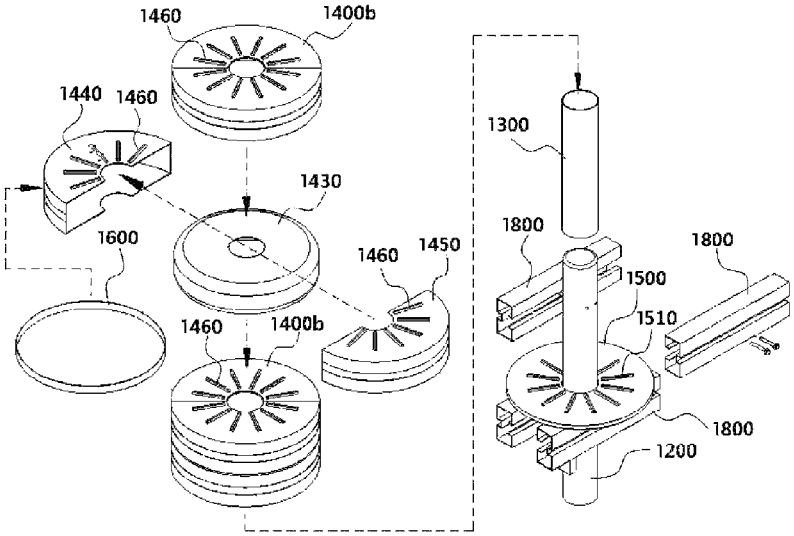
FIG. 80 is a view of a construction that an impact absorption member is installed in a pile in an impact absorption facility for road according to the present invention.

As shown in FIG. 80, it can be engaged to the outer left and right casings 1440 and 1450 instead of the impact absorption member 1400*a* configured as the first and second casings 1410 and 1420 are engaged and can be engaged by a high luminance reflection band 1600.

A plurality of impact absorption members 1400*b* with a plurality of protrusions 1460 radial-protruded in the upward and downward directions from the upper and lower surfaces of the left and right casings 1440 and 1450 are installed in the outer surface of the rotation support pipe 1300.

The impact absorption member 1400*a* is formed as much as the length of the rotation support pipe 1300 in an integral structure, and the impact absorption member 1400*b* is installed in multiply stacked structures. When a vehicle collides, it is engaged and rotates by means of the protrusions 140 formed in the upper and lower surfaces of the impact absorption member 1400*b*, so the rotation speed can be gradually decreased with the help of the protrusion 1510 formed in the upper surface of the rotation block plate 1500 fixed in the lower side of the pipe 1200 and the protrusion 1460 formed in the lower surface of the impact absorption member 1400*b* mounted on the upper surface of the rotation block plate 1500.

The cushioning member 1430 is formed in the interior of the impact absorption member 1400*b* and the left and right casings 1440 and 1450 are engaged with each other, and the ring groove 1480 is formed in the center surroundings of the outer surfaces of the engaged left and right casings 1440 and 1450, and a high luminance reflection band 1600 is engaged to the ring groove 1480 for thereby engaging the left and right casings 1440 and 1450.

Figure 81:
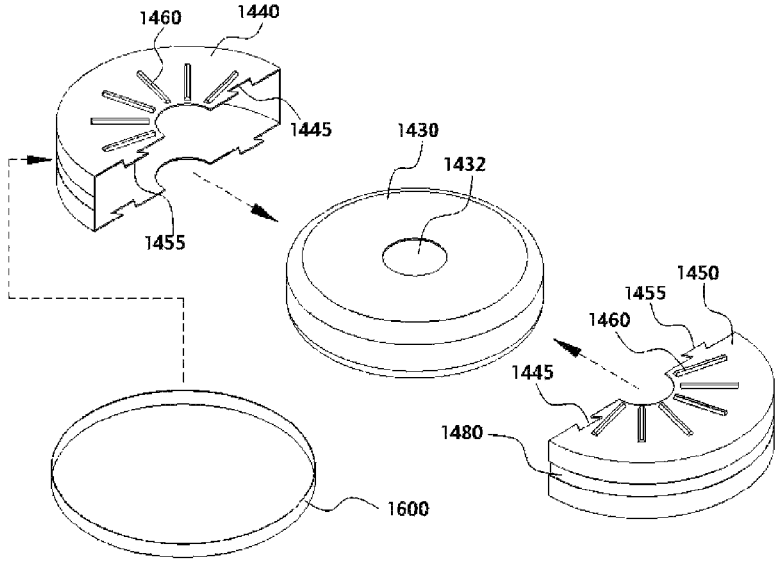
FIG. 81 is a view of an engaged state of an impact absorption member of an impact absorption facility for road according to the present invention.

As shown in FIG. 81, the engaging groove 1445 and the engaging protrusion 1455 are formed in one surface in which the left and right casings 1440 and 1450 surface-contact, and the engaging groove 1445 of the left casing 1440 is engaged with the engaging protrusion 1455 of the right casing 1450.

Figure 82:
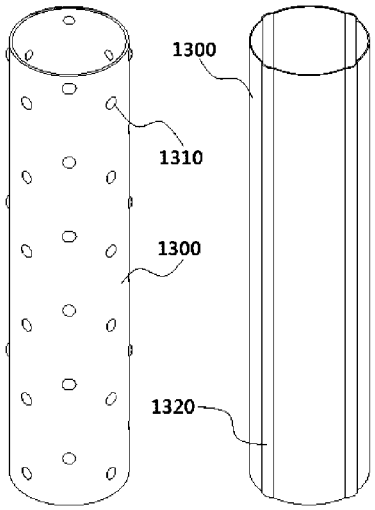
FIG. 82 is a view of a construction of a rotation support pipe of an impact absorption facility for road according to the present invention.

As shown in FIG. 82, a plurality of protrusions 1310 are outwardly protruded from an outer surface of the rotation support pipe 1300, and a plurality of vertical protrusion lines 1320 are protruded from a longitudinal outer surface of the rotation support pipe 1300.

With the above construction, it is possible to decrease the rotation speed of the rotation support pipe 1300 when a vehicle collides. Since the protrusions 1310 formed in the outer surface of the rotation support pipe 130 strongly rubs with an inner surface of the insertion holes 1470 of the impact absorption members 1400*a* and 1400*b* for thereby gradually decreasing the rotation. The vertical protrusion lines 1320 formed on an outer surface of the rotation support pipe 1300 strongly rub with an inner surface of the insertion hole 1470 of the impact absorption members 1400*a* and 1400*b*, so that the rotation speed of the impact absorption members 1400*a* and 1400*b* gradually decrease due to the frictional force.

Figure 83:
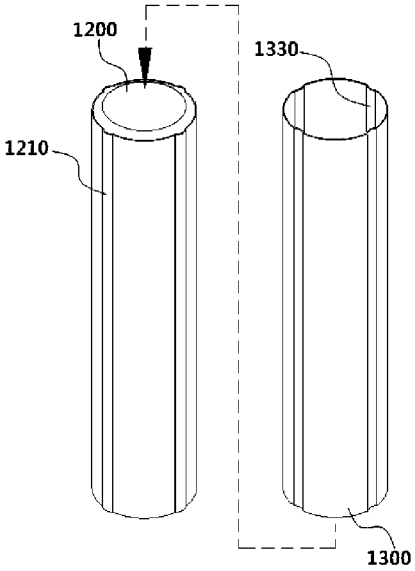
FIG. 83 is a view of an engaged state between a rotation support pipe and a pile of an impact absorption facility for road according to the present invention.

As shown in FIG. 83, a first protrusion line 1210 is vertically and longitudinally protruded from an outer surface of the pile 1200, and a second protrusion line 1330 is vertically and longitudinally protruded from an inner surface of the rotation support pipe 1300.

As the second protrusion line 1330 formed in an inner surface of the rotation support pipe 1300 is engaged with the first protrusion line 1210 formed in an outer surface of the pile 1200 for thereby reducing the rotation speed of the rotation support pipe 1300 when a vehicle collides, and at the same time the speed of the impact absorption members 1400*a* and 1400*b* are reduced.

As shown in FIGS. 73 and 74, the solar cell plate 1700 is installed on an upper surface of the pile 1200, and a guide line 1701 connected with the solar cell plate 1700 is installed in the interior of the pile 1200 and is connected with the controller 1710 with a battery and a control unit in a lower side of the pile 1200.

The guide line 1701 connected with the controller 1710 is connected with an alarm light 1720 installed on the upper side of the pile 1200 through the interior of the pile 1200. So, the power is collected by means of the solar cell plate 1700 at day and the light is emitted from the alarm light 1720 at night, so that a driver can easily recognize the running direction of the road for thereby preventing a safety accident and sleepiness at night.

As shown in FIG. 74, a plurality of safety guide lights 1730 connected with the controller 1710 through a guide line 1701 are installed in one side surface of the safety fence of the road direction installed in the upper side of the pile 1200 and function as an alarm light 1720 while generating a flash light which can be clearly different from a common light from a vehicle and a light from building.

The impact absorption facility 1100 for road according to the present invention equipped with the safety guide light 1730 enhances a safety running of a vehicle by helping the driver to clearly recognize the positions of the road structures.

As shown in FIG. 74, a plurality of distance detection sensors 1740 cooperating with the alarm light 1720 are installed in one side of the safety fence 1800 of the road direction installed in a lower side of the pile 1200 and are connected with the controller 1720 by means of a guide line 1701.

Therefore, when the vehicle approaches, it is alarmed by means of the lights and flashing of lights from the alarm light 1720 in cooperation with the alarm light 1720 with the help of the distance detection sensor 1740, so the driver of the vehicle can clearly recognize the running direction on the road for thereby obtaining a safety operation of the vehicle.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. In an impact absorption facility for road which is installed in a centerline of a road or a road side for absorbing and distributing the impact when a vehicle collides, an impact absorption facility for road, comprising;

a plurality of piles which are installed in a centerline of a road or a road side at regular intervals and are shaped in column-shapes;

a rotation support pipe 20 which is rotatably engaged to the pile 10;

a plurality of cushioning roller members 200*a* which are rotatably engaged to an outer surface of the rotation support pipe 20 and are equipped with engaging members 201 with the inner and outer sides of the same being made of integral elastic rubber materials and being formed in cylindrical shapes, with the outer side of the same being equipped with a high luminance reflection band 205;

a plurality of safety rails 300*a* which are installed in the cushioning roller member at regular intervals and are horizontally installed to both sides of the upper and lower side of each pile 10;

a first rotation block plate 600*a* which is installed in upper and lower ends of an outer surface of the rotation support pipe 20 equipped with the cushioning roller member 200*a*, with a first fixing groove 21 being formed in one surface of the rotation support pipe 20, with a second fixing groove 602 being formed in part of an inner surface of the engaging hole 601 and fixed by means of a first fixing pin 22, with a plurality of upwardly protruded radial first protrusions being formed in one side of the same; and a second rotation block plate 600*b* which is installed in the upper and lower sides of the pile 10 for mounting on the upper and lower surfaces of the first rotation block plate 600*a* installed in the upper and lower sides of the rotation support pipe 20, with a third fixing groove 11 being formed in one surface of the pipe 10, with a fourth fixing groove 602 being formed in pat of an inner surface of the engaging hole 601 for fixing by means of a second fixing pin 12, with a plurality of upwardly protruded radial first protrusions 603 being formed in the second rotation block plate 600b and engaged with one side in which the first protrusions 603 of the first rotation block plate 600*a* are formed.

2. The facility of claim 1, further comprising a plate-shaped curved protection piece 40 which is formed at both sides of the impact absorption facility 100 for road and is engaged to an outer surface of each safety rail 300*a* formed in both sides of the pipe 10 by bolts 45.

3. The facility of claim 1, further comprising a tetrahedron-shaped impact absorption plate 400*a* with both ends passing through in one surface of each pile 10 in order to surface-contact with one surface of the safety rail 300*a*.

4. The facility of claim 1, wherein instead of said safety rail 300*a*, a fourth impact member 500*d* is formed, with an impact absorption plate 400*b* being exposed from a front side, with a channel shaped engaging fixture 510 being equipped with an eclipse second bolt hole 511 in the upper and lower surfaces for engaging by bolts and nut when fixing the impact absorption plate 400*b* in one surface of the pile, with a third bolt hole 512 being formed in one surface for fixing to one surface of the pile 10, with a fourth impact member 500*d* being equipped with a cushioning spring 503 engaged to the channel shaped engaging fixture 510.

5. The facility of claim 1, further comprising an extension piece 301 formed as both ends of the safety rail 300*a* are inwardly bent and extended, with a channel shaped insertion piece 310 being formed as a shoulder part 302 is extended and bent along with each extension piece 301 and is inserted into the shoulder part 32, wherein said insertion piece 310 further includes a toothed pat 311 formed in the ends of the upper and lower surfaces.

6. The facility of claim 1, wherein said safety rail 300*a* includes an extension piece 301 formed as its both ends are inwardly bent and extended, with a plate shaped reinforcing plate 320 being surface-contacted with the extension piece 301 and engaged by bolts and nuts.

7. The facility of claim 1, wherein a plate shaped extension member 300*b* is further installed instead of the safety rail 300*a*, and an elastic member 400*c* is formed in one surface of the pile 10 and is engaged through the curve shaped support par 403 and the bolts 45 and bolt-engaged by the extension member 300*b* as surface contact parts 404 are horizontally extended from both sides of the support part 403.

8. The facility of claim 1, wherein a first rotation block plate 600*a* is not installed at the upper and lower side of the pile 10, and a plurality of protrusions 203 upwardly protruded or a plurality of radial second engaging grooves 204 downwardly concaved from the upper and lower surfaces of the cushioning roller member 200*a* are installed instead.

9. The facility of claim 1, wherein said cushioning roller member 200*a* is formed of a reinforcing pipe 240 in an engaging member 201, with male threads 241 being formed on an outer surface of the reinforcing pipe 240, with female threads 206 being formed in the engaging member 201 of the cushioning roller member 200*a*.

10. The facility of claim 9, wherein when a cushioning roller member 200*a* with female threads 206 in the engaging member 201 is manufactured as the reinforcing pipe 240 with the male threads 241 are formed in the engaging member 201, a cushioning roller member 200*a* is manufactured through a process consisting of a step for installing the reinforcing pipe 240 with the male threads 241 in the mold of the cushioning roller member 200*a*, a step for inputting a foam polymer material after the reinforcing pipe 240 is installed, a sep for foam-forming the foam polymer material and a step for removing the mold.

11. The facility of claim 1, wherein first and second rotation block plates 600*a* and 600*b* and cushioning roller member 200*a* are installed in front of the pile 10 on a road, and a pair of piles are continuously installed being opposite to each other and are equipped with the first and second rotation block plates 600*a* and 600*b* and cushioning roller member 200*a* in a rear side of the installed pile 10, and a rectangular pipe-shaped impact absorption plate 400*b* is integrally formed for connecting the outer surfaces of the upper and lower sides of the pile 10.

12. The facility of claim 1, wherein there is provided a certain structure in which the safety rail is not installed, and the rotation support pipe 20 with the cushioning roller member 200*a* having the second protrusion 203 or the second engaging groove 204*b* in its upper and lower sides is installed in the pile 10 after the second rotation block plate 600*b* is engaged to its lower side.

13. The facility of claim 1, wherein when installing a sun visor net 30*a* connecting the upper ends of the piles 10 of both sides of the impact absorption facility 100 for road, an upside down channel shaped clamp 19 is engaged to the upper end of the pile 10 by means of bolts 45 when installing along with the safety rail 300*a* and the impact absorption plate 400, and a sun visor net pile 31 is fixed on an upper surface of the clamp 19, and a sun visor net 30*a* is installed in one side of the sun visor net pile 31.

14. The facility of claim 13, wherein a punched sun visor plate 30*b* is installed in each pile of the impact absorption facility for road instead of the sun visor net 30*a*.

15. The facility of claim 1, wherein a safety rail 300*a* for interconnecting the piles 10 is installed between the cushioning roller members 200*a* to connect the piles 10.

16. The facility of claim 1, wherein when a safety rail 300*c* is installed at both sides of the upper and lower ends of the pile 10, a longitudinally concaved rail guide 303 is formed in one side of the safety rail 300*c*, and a contact guide 304 of which upper and lower surfaces are vertically extended and connected is formed in the other surface of the same, and an engaging groove 305 is formed in the rail guide 303 of the safety ail 300*c* at regular intervals, and a rail cap 330 is engaged to the engaging groove 305.

17. The facility of claim 1, wherein a solar cell plate is installed in an upper side of the pile, and a guide line connected with the solar cell plate is installed in the interior of the pile and is connected with the controller, with a battery and a control unit being installed in the lower side of the pile, and the guide line connected with the controller is connected with an alarm light installed in an upper side of the pile through the interior of the pile, and a plurality of safety guide lights are installed in one side of the safety fence installed in the upper side of the pile, and are connected by the controller and the guide line.

* * * * *